US005651219A

United States Patent [19]

Baloga et al.

[11] Patent Number: 5,651,219

[45] Date of Patent: Jul. 29, 1997

[54] DYNAMIC WORKSPACE MODULE

[75] Inventors: Mark A. Baloga, Grand Rapids, Mich.; Paul B. Siebert, Chicago, Ill.; Marvin La Lone, Alto, Mich.; David J. Luzenske, Grandville, Mich.; Brian B. Chambers, Byron Center, Mich.; Michael E. Tingley; Gregg R. Draudt, both of Cambridge, Mass.; Steven W. Eriksson, Grand Rapids, Mich.

[73] Assignee: Steelcase Inc., Grand Rapids, Mich.

[21] Appl. No.: 450,525

[22] Filed: May 25, 1995

Related U.S. Application Data

[62] Division of Ser. No. 145,073, Oct. 29, 1993, Pat. No. 5,452,547.

[51] Int. Cl.[6] ..... A47B 5/00

[52] U.S. Cl. ..... 52/32; 52/36.1

[58] Field of Search ..... 52/32, 36.1, 239, 52/242, 243.1, 72, 27.5; 49/40, 41, 13

[56] References Cited

U.S. PATENT DOCUMENTS

| | | | |
|---|---|---|---|
| D. 285,005 | 8/1986 | Italiane | D25/16 |
| 478,505 | 7/1892 | Eglin . | |
| 822,493 | 6/1906 | Turner . | |
| 1,258,439 | 3/1918 | Ogden | 160/197 |
| 1,731,327 | 10/1929 | Terrissee . | |
| 2,058,397 | 10/1936 | Baker | 414/923 |
| 2,154,641 | 4/1939 | Seaman | 20/16 |
| 2,208,198 | 7/1940 | Seaman | 20/16 |
| 2,687,310 | 8/1954 | Goetz | 280/79.7 |
| 3,427,768 | 2/1969 | Fulton | 52/36 |
| 3,498,011 | 3/1970 | Lindgren | 52/31 |
| 3,533,513 | 10/1970 | Berman | 211/177 |
| 3,733,759 | 5/1973 | Schulte et al. | 52/36.1 |
| 3,862,525 | 1/1975 | Greensspan | 52/64 |
| 3,891,288 | 6/1975 | Marquette | 211/176 |
| 3,913,656 | 10/1975 | Guyer | 160/135 |

(List continued on next page.)

FOREIGN PATENT DOCUMENTS

| | | |
|---|---|---|
| 3423562A1 | 1/1986 | Germany . |
| 3607365A1 | 9/1987 | Germany . |
| 3712214 | 10/1987 | Germany . |
| 5813073 | 1/1975 | United Kingdom . |

OTHER PUBLICATIONS

"The Telematic Tree", by Francesco Innamorti, Habitat Ufficio, (7 pgs.), Jun./Jul. 1991, (including English language translation).

"Office Furniture Show Focuses On the Touchy, Feely", by Mary Radigan, The Grand Rapids Press, Jun. 16, 1991, (3 pgs.).

"Future Is Coming", by Sharon Stangenes, Chicago Tribune, Jun. 30, 1991, (3 pgs.).

"Getting Comfortable With Technology", by Herman Miller Research and Design, publication date unknown, (10 pgs.).

"Man Space Office Environment", by Bosse Production GmbH, German, (10 pgs.), 1987.

"Communications And Microtechnology", Knoll International–Third Generation Office, date unknown, source unknown, (2 pgs.).

(List continued on next page.)

*Primary Examiner*—Kien T. Nguyen

*Attorney, Agent, or Firm*—Price, Heneveld, Cooper, DeWitt & Litton

[57] ABSTRACT

A dynamic workspace module is provided for open plan spaces, and the like, and includes a compact footprint, comprising a freestanding framework supporting a three-sided partition to form an interior workspace and a portal opening for user ingress and egress. A door partition shaped to selectively close the portal opening is movably mounted on the framework. The door partition preferably has an arcuate plan shape, and is positioned adjacent one side of the portal opening, such that shifting the door partition from the fully open position to the fully closed position both increases the amount of the interior space in the workspace module, and alters the plan shape thereof for improved freedom of user movement, while alleviating any sense of user claustrophobia.

36 Claims, 19 Drawing Sheets

U.S. PATENT DOCUMENTS

| | | | |
|---|---|---|---|
| 4,224,769 | 9/1980 | Ball et al. | 52/36 |
| 4,282,689 | 8/1981 | Royer | 52/79.6 |
| 4,291,811 | 9/1981 | Shaver | 40/605 |
| 4,348,966 | 9/1982 | Hastings | 109/6 |
| 4,470,232 | 9/1984 | Condevaux et al. | 52/242 |
| 4,475,465 | 10/1984 | Hastings | 109/2 |
| 4,478,006 | 10/1984 | Johnson, Jr. | 49/410 |
| 4,571,898 | 2/1986 | LeCacheux | 52/36 |
| 4,598,495 | 7/1986 | Labarile | 49/41 |
| 4,681,044 | 7/1987 | Dallman | 109/24.1 |
| 4,715,154 | 12/1987 | Baloga | 52/239 |
| 4,876,835 | 10/1989 | Kelley et al. | 52/239 |
| 4,928,429 | 5/1990 | Colombo | 49/41 |
| 5,009,042 | 4/1991 | Sacco et al. | 52/36 |
| 5,024,398 | 6/1991 | Riedinger et al. | 244/118.5 |
| 5,072,999 | 12/1991 | Trotta et al. | 312/249 |
| 5,090,171 | 2/1992 | Kano et al. | 52/243.1 |
| 5,282,341 | 2/1994 | Baloga et al. | 52/32 |

OTHER PUBLICATIONS

"Estenzioni", by Matthew Salerno, (4 pgs.), 1985.

"Tempo 3 Office Systems" by Shaw Walker, Muskegon, MI, (5 pgs.), 1985.

"Making And Managing High–Quality Workplaces", by Fritz Steele, Teachers College Press, New York, NY, (4 pgs.), 1986.

"Your Office Is Where You Are", by Philip Stone and Robert Luchetti, Harvard Business Review, Boston, MA, (9 pgs.), 1985.

"Japanese Furniture Looks Toward The Future", by Contract, (pp. 116 and 117), Jan. 1989.

-2-

175
174
173
172

7
73
70
71
160
163
162
164
30

167
7
71
74
168
169
165
166
30

7
72
80
70
74
174
172
165
167
166
30
13
40
73
171
3
68
170
23
25
24
22
12
161
160
162
71

DYNAMIC WORKSPACE MODULE

CROSS-REFERENCES TO RELATED APPLICATIONS

This is a divisional of application Ser. No. 08/145,073, filed on Oct. 29, 1993 now U.S. Pat. No. 5,452,547.

The present application is related to commonly assigned, co-pending U.S. patent application Ser. No. 774,563 filed Oct. 8, 1991 entitled FURNITURE SYSTEM, which is hereby incorporated by reference.

BACKGROUND OF THE INVENTION

The present invention relates to workstations, and in particular to a dynamic workspace module for open plan spaces, and the like.

Open office plans are well known in the art, and generally comprise large, open floor spaces in buildings that are furnished in a manner that is readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are interconnected in a side-by-side relationship, with upstanding privacy screens attached to at least some of the furniture units to create individual, distinct workstations and/or offices.

Such prior art partitioning arrangements create relatively permanent, multi-function workstations for the users, which workstations are required to support both individual work activities, as well as at least some types of group activities, such as inter-office conferences, and the like. However, these types of conventional workstation arrangements are not particularly adapted to support workers engaged in group work, such as self-managing teams, or others involved in team problem solving techniques, wherein a relatively large number of workers from different disciplines, such as engineering, design, manufacturing, sales, marketing, purchasing, finance, etc., meet together as a group to define and review issues, and set general policy, and then break out into either smaller sub-groups, or into individual assignments or projects to resolve those specific problems relating to their particular discipline. Group work is steadily gaining importance as a way of improving productivity and time-to-market, thereby emphasizing the need to support such activities more efficiently and effectively.

Conventional, built-in offices and conference rooms are typically expensive to construct and maintain, and are not usually considered an efficient use of space in open plan environments. When such conventional rooms are constructed in rented office space, they become permanent leasehold improvements, which must be depreciated over a lengthy time period, and can not be readily moved upon the expiration of the lease. The reconfiguration of such spaces is quite messy, and very disruptive to conducting day-to-day business. Furthermore, with conventional conference room arrangements, breakout meetings among the various sub-groups of workers often prove inconvenient, since the offices of the participant workers are seldom located in close proximity to the conference room.

Group problem-solving techniques necessarily involve some degree of interaction between coworkers, thereby creating the need in furnishings for modern office environments to promote the establishment of an optimum balance between worker privacy and worker interaction. Throughout a given workday, an office worker normally oscillates between interaction with others and time spent alone. Each such worker actively seeks out or avoids others based upon their ever changing tasks, objectives, and goals. Furnishings can serve to help these workers better regulate involvement with or isolation from coworkers. For example, full height offices are known for privacy. Their surrounding walls and door provide privacy by consistently controlling unwanted distractions, but often limit opportunities for spontaneous interaction. On the other hand, open offices precipitate an awareness of coworkers. Furniture and partition based workstations encourage participation by convenient access, but often lack sufficient controls for individual quiet work. Private workspace, and convenient access to coworkers for the completion of work involving group or team efforts are both quite important to the overall success of such collaborative projects.

The efficient use of building floor space is also an ever growing concern, particularly as building costs continue to escalate. Many types of highly trained "knowledge workers", such as engineers, accountants, computer programmers, and the like, are now being supported in open office settings, instead of conventional private offices, in order to gain increased efficiency of real estate and life cycle costs. Since knowledge workers typically constitute a major portion of group problem solving teams, it is quite important to provide such highly skilled workers with furnishings that can establish a proper balance between worker privacy and worker interaction, while still employing the efficiency of an open office plan.

SUMMARY OF THE INVENTION

One aspect of the present invention is a compact and dynamic workspace module capable of creating an efficient and effective personal work environment for knowledge workers, and the like in open plan spaces. The workspace module includes a freestanding framework supporting a three-sided partition arranged to form an interior workspace and a portal opening for user ingress and egress. A door partition is shaped to selectively close the portal opening, and is movably mounted on the framework. The door partition preferably has an arcuate plan shape, and is positioned adjacent one side of the portal opening, such that shifting the door partition from the fully open position to the fully closed position increases the amount of interior space in the workspace to provide both improved freedom of user movement, and a sense of roominess and comfort.

Preferably, the door partition is suspended from the framework, and is mounted adjacent a planar sidewall, such that shifting the door partition to the fully closed position not only increases the amount of interior space in the workspace, but also alters the plan shape of the interior space. The door partition may be provided with a visual indicator which signals in selective increments the relative location of the door partition between the fully open and fully closed positions to facilitate achieving a better balance between worker privacy and worker interaction. The workspace module has a construction which permits is to be readily transported between project sites, and may include a knock down, post and beam framework to permit moving the workspace module between different buildings or floors, and may also include wireways to equip the workspace module with both power and signal.

Another aspect of the present invention is a compact dynamic workspace module having a sidewall partition configured to define a three-sided workspace with at least one generally flat planar sidewall and an adjacent portal opening for user ingress and egress. A door partition configured to selectively close the portal opening is movably supported adjacent one side of the portal opening, and permits sliding the door partition sideways between a fully open position, and a fully closed position. The door partition has an outwardly protruding top plan configuration, and is supported to move in a generally horizontal direction about the portal opening in a manner such that shifting the door partition sideways from the fully open position to the fully closed position both increases the preselected amount of interior space in the workspace, and alters the plan shape thereof, by temporarily capturing or borrowing space immediately outside the portal opening, so as to provide improved freedom of user movement, as well as a sense of roominess and comfort.

Yet another aspect of the present invention is a column and beam framework for a portable workspace module that is particularly adapted for use in open plan spaces, and the like. A freestanding framework is provided with a plurality of vertical columns adapted to abut the floor surface, and an overhead frame supported on the columns at an elevation above average user height. A sidewall partition is supported on the framework, and is configured to define a three-sided workspace having a preselected amount of interior space and a portal opening for user ingress and egress therethrough. A door partition configured to selectively close the portal opening is movably supported on the framework to permit shifting the door partition between a fully open position adapted for worker interaction, and a fully closed position adapted for worker privacy.

Yet another aspect of the present invention is a mobile workspace module that is particularly adapted for use in open plan spaces, and the like. A freestanding framework is provided with at least three vertical columns arranged in a triangular top plan relationship, with the lower ends thereof adapted for abutting support on a floor surface, and upper ends thereof connected with and supporting at least one overhead beam. A sidewall partition is supported on the framework, and is configured to define a three-sided workspace and a portal opening for user ingress and egress. The lower ends of the columns are configured to permit the workspace module to be bodily transported between different project sites.

Yet another aspect of the present invention is a space planning tool for office arrangements in open plan spaces, and the like, having a building floor with a predetermined floor area defined by a set perimeter. A plurality of portable workspace modules are provided, each having a substantially identical footprint defining a private workspace, with a portal opening and an associated movable door. Each movable door has an outwardly protruding top-plan configuration oriented to increase the size of the associated private workspace when the door partition is closed by temporarily capturing or borrowing a portion of the floor space disposed immediately outside of the portal opening. The workspace modules are positioned in a generally side-by-side fashion along the perimeter of the floor area, and are oriented with their portal openings facing inwardly toward a center portion floor area to define a common workspace. When the door partitions are fully opened, the amount of common workspace is maximized for collaborative coworker activities. When the door partitions are fully closed, the cumulative amount of private space is maximized for individual worker activities.

A furniture arrangement may be provided in the common workspace to more effectively support collaborative coworker activities, and may include a unique furniture system having an overhead support positioned in the common workspace at a predetermined elevation above average user height. A plurality of panels are provided, each being constructed to permit easy, manual, bodily translation of the same by an adult user, and including a connector for mounting the same on the overhead support in a manner in which each panel hang downwardly, and is readily and easily removable from the overhead support by the user. The overhead support has a hanger which cooperates with the connectors on the panels to permit each of the panels to be individually and detachably hung at various locations along the overhead support. The panels may be provided with an acoustic construction and/or a visual display to more effectively support group activities.

The principle objects of the present invention are to provide a compact and dynamic workspace module that is particularly adapted to effectively and efficiently support knowledge workers engaged in group work activities in open plans, and the like. The workspace module is preferably configured such that when the door partition is moved to its fully closed position, the interior workspace expands, the shape changes, and interior walls and appliances are automatically exposed, thereby improving freedom of user movement and user effectiveness, and evoking a sense of roominess and comfort. The workspace module is preferably freestanding, such that it can be easily transported and reconfigured within a given workspace, and may have a knock-down construction which permits the same to be readily disassembled and reassembled at new project locations. The overhead framework may include raceways to equip the workspace module with power, signal, lighting, and other utilities. Communication devices, and other similar office appliances may be built into the interior of the workspace module in a vertically stacked array adjacent one side of the seated user to effectively support the user. A mobile personal storage unit adapts the workspace module to be used by multiple workers, and a mobile worksurface equips the workspace module for both private and conference activities. The workspace module is extremely flexible and dynamic to meet the ever changing needs of various users, is economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
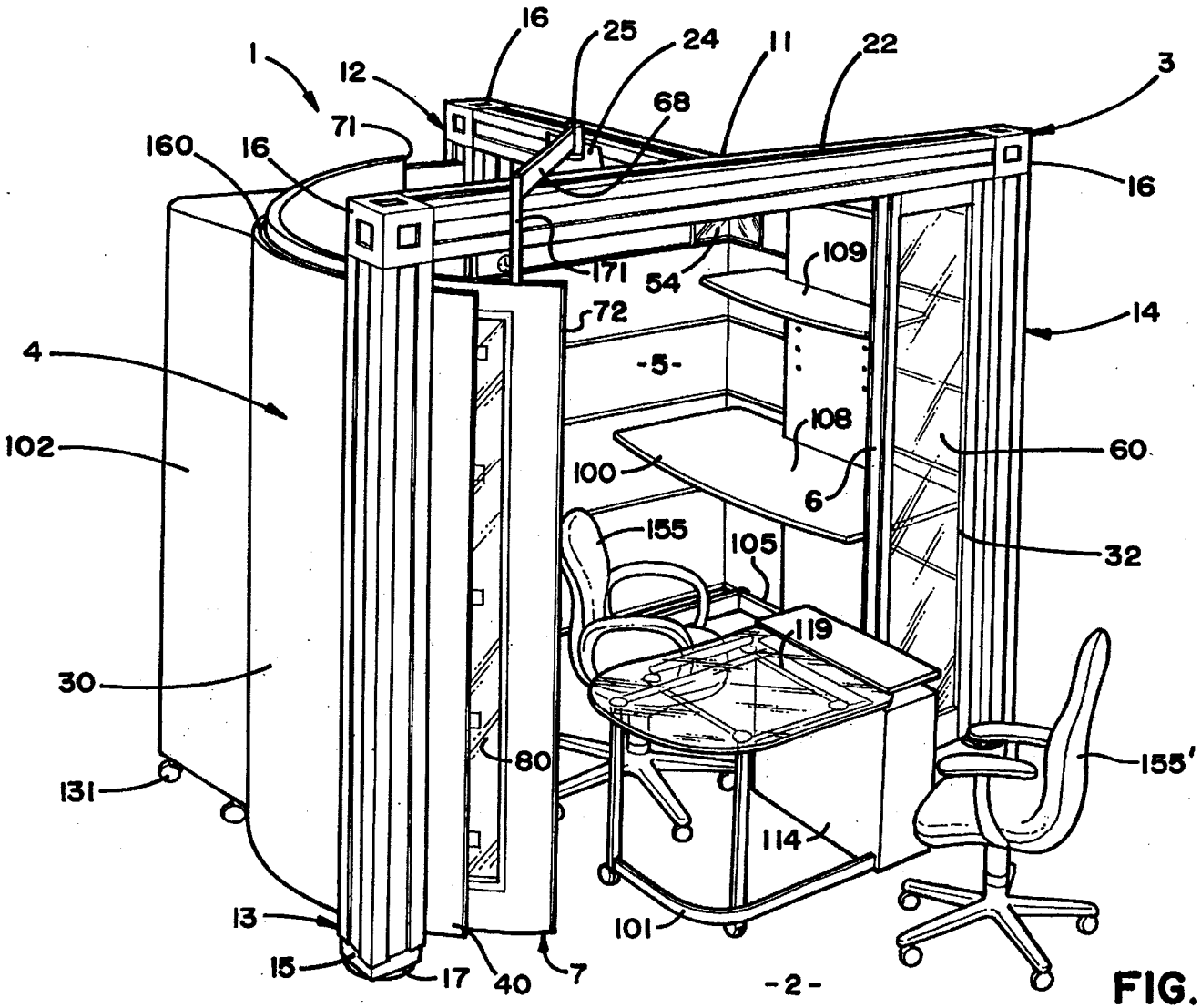
FIG. 1 is a perspective view of a workspace module embodying the present invention, shown configured for worker interaction with a door partition portion thereof in a fully open position.
Figure 2:
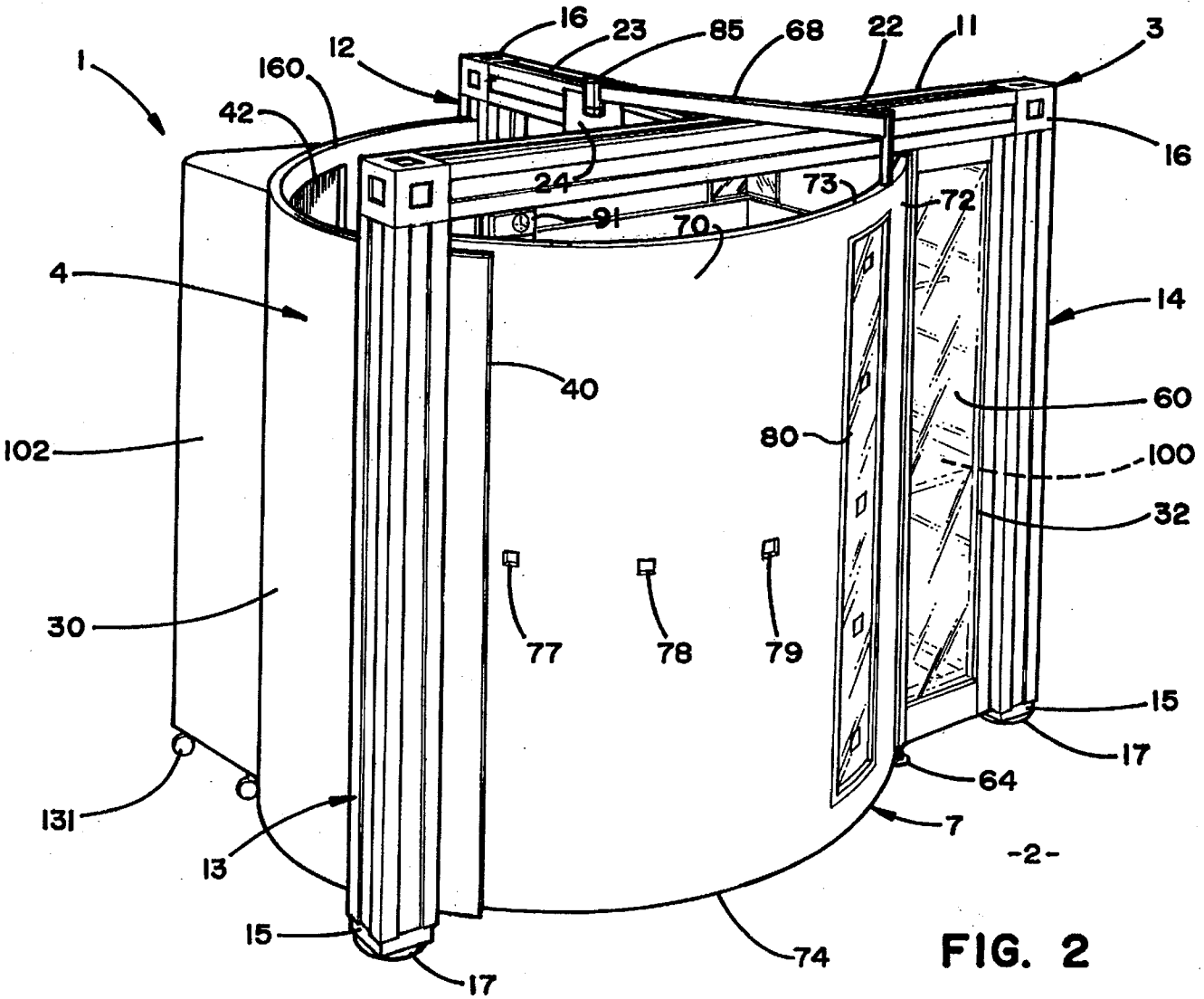
FIG. 2 is a perspective view of the workspace module, shown configured for worker privacy with the door partition in a fully closed position.

For purposes of description herein, the terms "upper", "lower", "right", "left", "rear", "front", "vertical", "horizontal", and derivatives thereof shall relate to the invention as oriented in FIGS. 1 and 2, with reference to a viewer outside of the workspace module, directly facing the front of the same. However, it is to be understood that the invention may assume various alternative orientations and step sequences, except where expressly specified to the contrary. It is also to be understood that the specific parts, devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a workspace module embodying the present invention. Workspace module 1 is particularly adapted for creating an efficient and effective personal work environment for knowledge workers in open plans, and other similar settings, such as the illustrated open office space 2. Workspace module 1 includes a freestanding framework 3, which supports a three-sided partition assembly 4 arranged to form an interior workspace 5 and a portal opening 6 for user ingress and egress therethrough. A door partition 7 is shaped to selectively close portal opening 6, and is movably mounted on framework 3. Door partition 7 has an arcuate plan shape, and is positioned adjacent one side of portal opening 6, such that shifting door partition 7 from the fully open position illustrated in FIG. 1 to the fully closed position illustrated in FIG. 2, increases the amount of space in the interior workspace 5 of module 1, and alters its plan shape for improved freedom of user movement and comfort.

With reference to FIGS. 8–13, framework 3 is preferably a rigid, freestanding structure, and in the illustrated example, comprises an overhead frame 11, and three vertical posts or columns 12–14 which support overhead frame 11 above the floor surface 8 at a predetermined elevation generally above average user height. Vertical columns 12–14 have a substantially identical construction, and each includes a vertically adjustable foot assembly 15 mounted at the lower end thereof, and a beam connector 16 mounted at the upper end thereof. Each column foot assembly 15 may include a caster, or other similar means, such as the illustrated glide 17, to facilitate manually translating workspace module 1 over the floor surface 8 of the building to facilitate arranging workspace modules 1 on a given floor surface 8. Each of the illustrated vertical columns 12–14 has a substantially square transverse cross-sectional configuration, and is hollow to facilitate routing various utilities therethrough, such as wires to provide power, signal, lighting, etc. to workspace module 1, as described in greater detail hereinafter.

Vertical columns 12–14 (FIGS. 8–13) are mutually spaced apart in a presetected triangular plan relationship, with portal opening 6 disposed inbetween vertical columns 13 and 14. The triangular plan arrangement of vertical columns 12–14 provides workspace module 1 with an efficient, cost effective framework 3 possessing both strength and stability, which establishes three-point contact with the floor surface 8. Vertical columns 12–14 may include a decorative exterior to improve the overall appearance of workspace module 1, and in the present example, each vertical column 12–14 includes four removable decorative facia strips 18 extending along each face of the associated vertical column.

The overhead frame 11 illustrated in FIGS. 8–13 includes a threshold beam segment 22, and a cross-beam segment 23, which extends perpendicularly from a medial portion of threshold beam segment 22, such that overhead frame assumes a generally T-shaped plan configuration. Overhead beam segments 22 and 23 have a construction similar to vertical columns 12–14, and include a substantially square transverse, cross-sectional shape, with a hollow interior to facilitate routing utilities therethrough, such as wires to provide power and signal to workspace module 1. Removable decorative facia strips 18' are fastened to the faces of each of the framework beam segments 22 and 23 to provide an exterior appearance substantially identically to that of vertical columns 12–14. An angle brace 24 extends between medial portions of threshold beam segment 22 and cross beam segment 23, and has its opposite ends fixedly attached thereto at the left-hand side of overhead framework 11, as viewed facing portal opening 6 from outside of workspace module 1. Angle brace 24 includes an upwardly protruding axle or shaft 25 which facilitates the mounting of door partition 7 in the manner described in greater detail hereinafter.

In the illustrated example, three beam connectors 16 (FIGS. 8–13) are provided, each having a substantially identical configuration, comprising a generally cubicle exterior with a hollow interior that permits the routing of utilities therethrough, such as power and signal cables. Beam connectors 16 are preferably detachably connected with the upper ends of vertical columns 12–14, and the exterior ends of framework beam segments 22 and 23 by screws, bolts, or other similar fasteners, such that framework 3 can be readily disassembled or knocked-down for storage and/or transport, and then reassembled at a new location. Beam connectors 16 preferably have an exterior appearance which matches that of columns 12–14 and framework beam segments 23–24. In the illustrated example, each exposed face of the beam connector 16 has a removable decorative square frame or reveal 29 which is aligned with and matches the decorative facia strips 18 and 18' of vertical columns 12–14 and framework beam segments 22–23.

Figure 9:
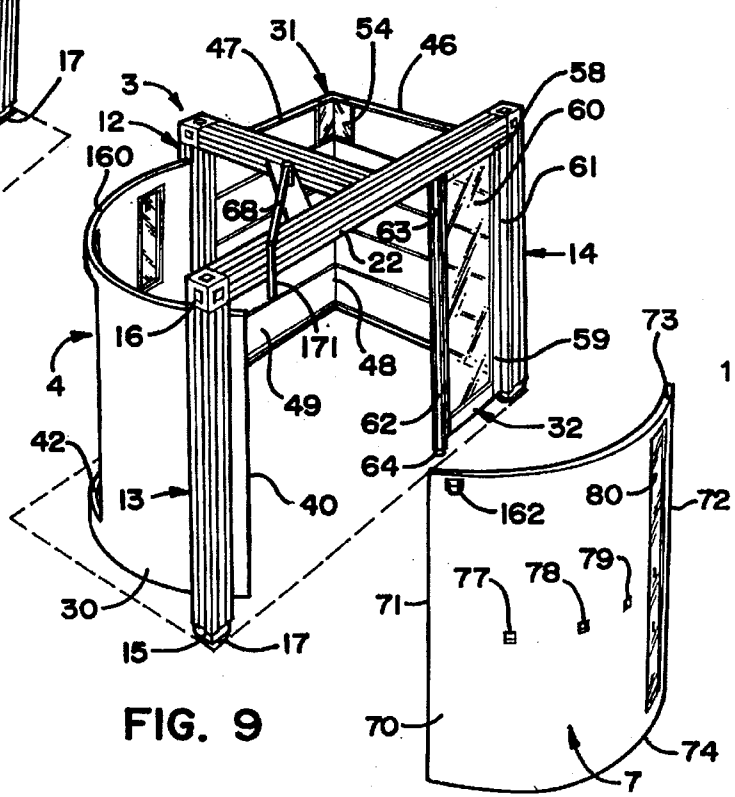
FIG. 9 is a perspective view of the framework, shown with a sidewall partition thereof, and a door partition exploded away.
Figure 8:
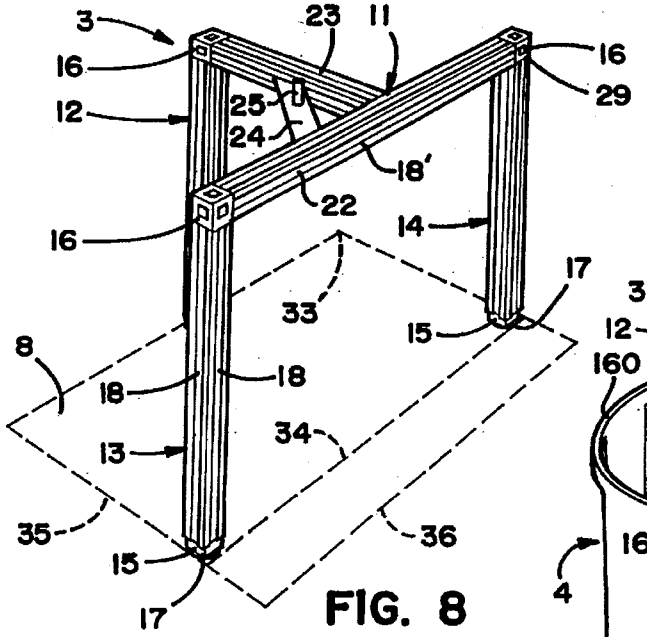
FIG. 8 is a perspective view of a framework portion of the workspace module.
Figure 13:
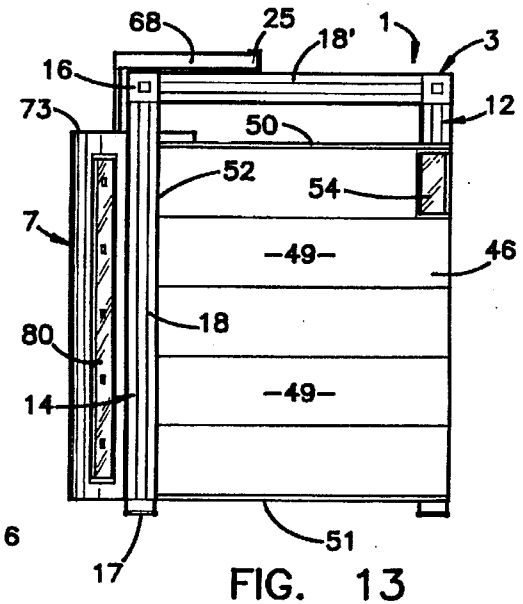
FIG. 13 is a right-hand side elevational view of the workspace module, shown with the door partition in its fully closed position.

Three-sided partition 4 (FIGS. 9–13) is connected with framework 3, such that it forms a unitary type of workspace module that is particularly adapted for efficient space planning, as described below. The illustrated three-sided partition 4 includes a curved corner partition 30 which extends between and is connected with vertical columns 12 & 13, a ninety degree (90°) corner partition 31 which extends between and is connected with vertical columns 12 & 13, and a door jamb partition 32 which has one edge connected with vertical column 14, and extends laterally toward vertical column 13. As best illustrated in FIGS. 8 and 9, partitions 30–32 are arranged in conjunction with framework 3 so as to form a predetermined plan configuration or footprint having a substantially rectangular shape, with a given length dimension measured along the broken line 34, a given minimum width dimension measured along the broken line 35 which corresponds to when door partition 7 is fully open, and a maximum width dimension measured along the broken line 36 which corresponds to when door partition 7 is fully closed, all of which serve to assist in space planning, as described in greater detail hereinafter.

Figure 4:
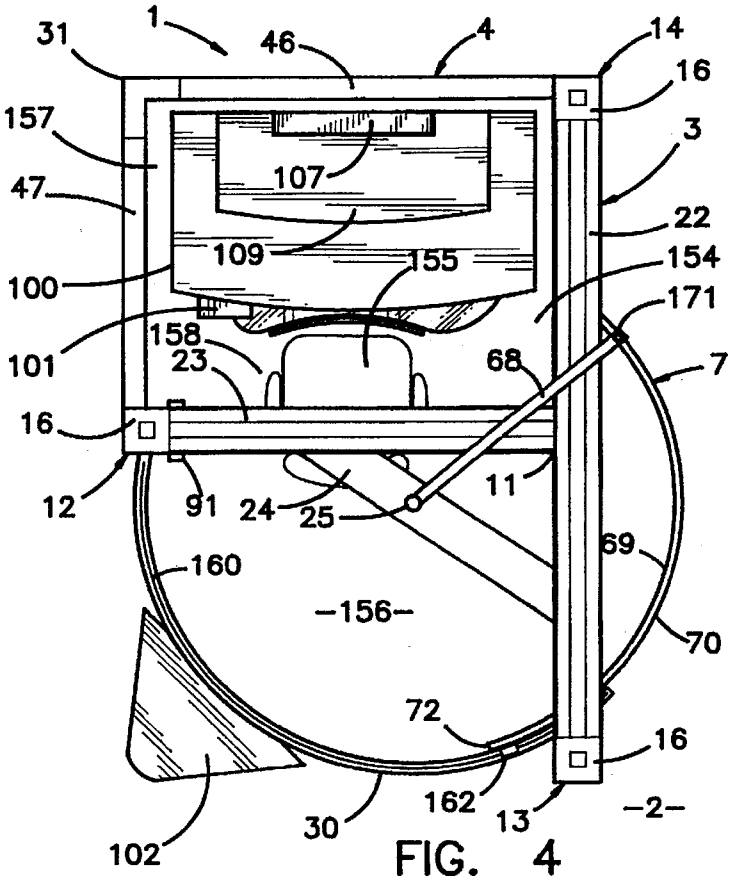
FIG. 4 is a top plan view of the workspace module, shown configured for worker privacy.
Figure 3:
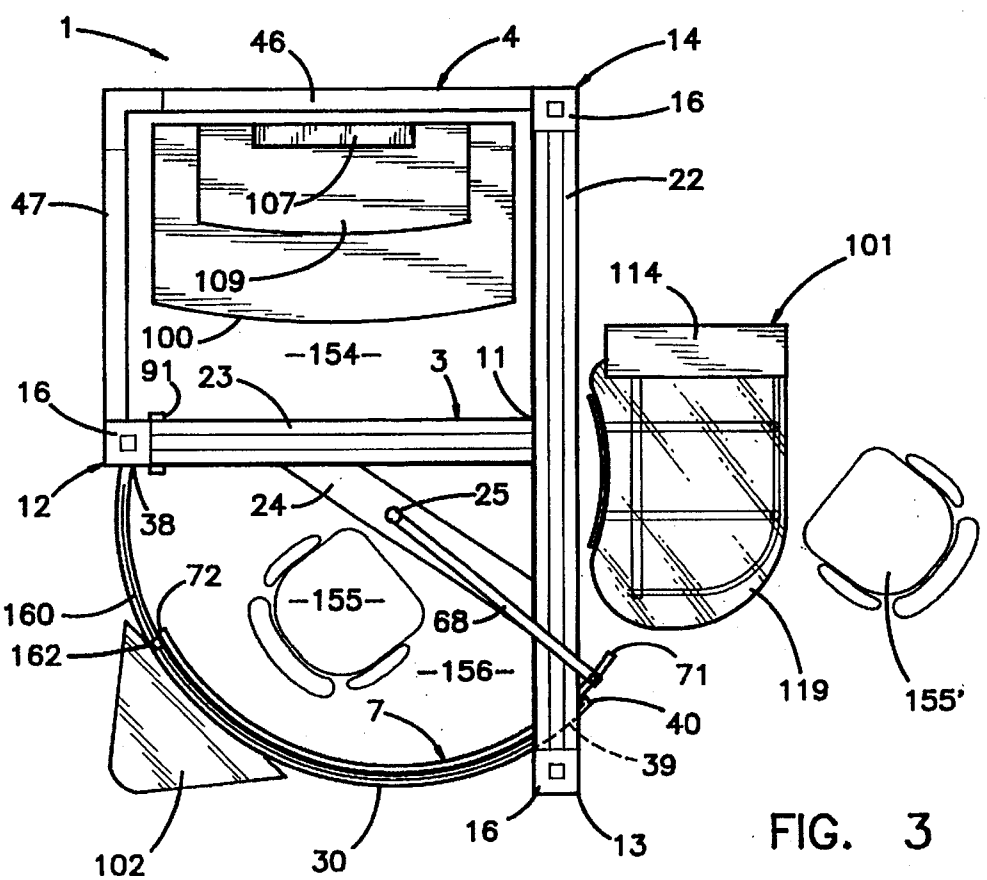
FIG. 3 is a top plan view of the workspace module, shown configured for worker interaction.

Curved corner partition 30 has a substantially arcuate plan configuration, and as best illustrated in FIGS. 3 and 4, has its rearward side edge 38 connected with a medial portion of vertical column 12 on the left-hand side thereof, as viewed facing portal opening 6 from outside workspace module 1. The opposite side of curved corner partition 30 extends along the inside portion of the intersection of vertical column 13 and threshold beam segment 22, and has an outside portion 39 connected with vertical column 13 in the manner described below. In the illustrated example, the forward side edge 40 of curved corner partition 30 extends forwardly of outside portion 39 to a location slightly forward of the front faces of vertical column 13 and threshold beam segment 22. However, the forward side edge 40 of curved corner partition could also be located substantially flush with the exterior face of threshold beam segment 22. In either case, the side edge 40 of curved corner partition 30 thereby defines the left-hand side of portal opening 6, as viewed facing portal opening 6 from outside workspace module 1.

Figure 10:
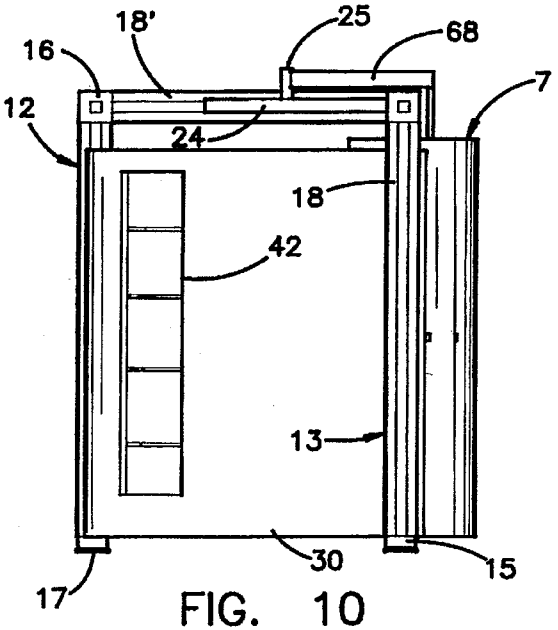
FIG. 10 is a left-hand side elevational view of the workspace module, shown with the door partition in its fully closed position.
Figure 12:
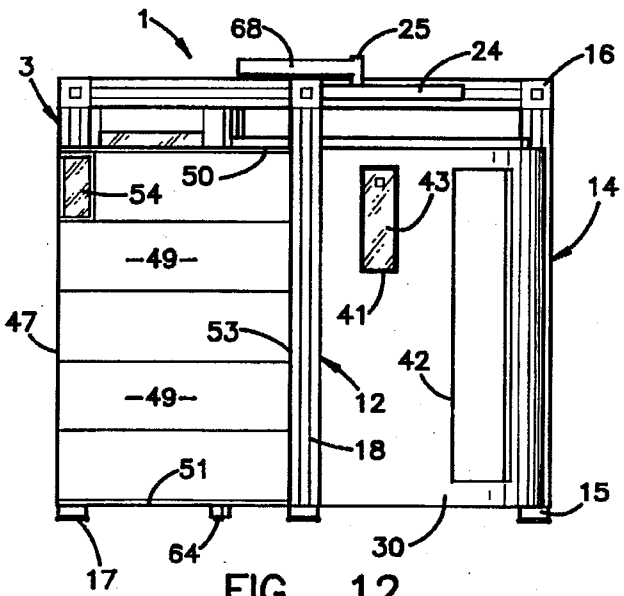
FIG. 12 is a rear elevational view of the workspace module, shown with the door partition in its fully closed position.
Figure 35:
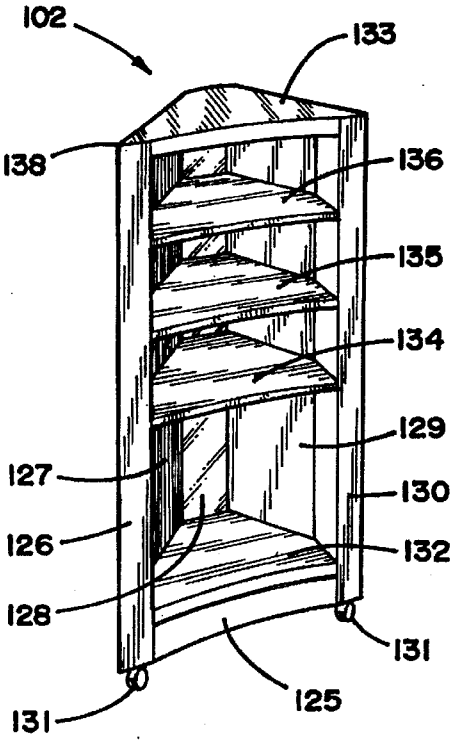
FIG. 35 is a perspective view of the personal storage unit.

Curved corner partition 30 has a plan configuration in the form of an arc, or circle segment whose center is defined by door support shaft 25, and whose radius is slightly greater than that of curved door partition 7. Curved corner partition 30 has a vertical height slightly less than the height of vertical columns 12–14, as best shown in FIGS. 10–13, and extends between a location slightly below the associated beam connector 16, and slightly above column foot assembly 15. With reference to FIGS. 10 and 12, curved corner partition 30 includes two openings 41 and 42, which are arranged in a side-by-side fashion. Opening 41 includes a window assembly or transparent light panel 43, and serves to improve the lighting within the interior of workspace module 1, particularly when door partition 7 is closed, without sacrificing privacy or security. Opening 42 is not covered, but rather is open, and adapted to mate with an associated personal storage unit 102 (FIG. 35), as described below. The illustrated partition openings 41 and 42 have a substantially rectangular configuration, with open 42 extending vertically along a major portion of the height of curved corner partition 30.

Ninety degree corner partition 31 (FIGS. 9–13) has a generally L-shaped plan configuration, comprising two panels 46 and 47, which are rigidly interconnected in a perpendicular relationship along their common edge 48. Each partition 46 and 47 includes a plurality of horizontally oriented, vertically stacked acoustic panels 49, with top and bottom cover strips 50 and 51 respectively. The outside edge 52 of panel 46 is attached to the rearward face of column 14, flush with the right hand-side thereof, and the outside edge 53 of panel 47 is attached to the right-hand face of vertical column 12, flush with its rearward side thereof. In the illustrated example, each of the panels 46 and 47 includes a small light panel 54 positioned at the uppermost portion of common edge 48, which in conjunction with the other windows in workspace module 1, serve to enhance the occupant's spatial perception, particularly when door partition 7 is fully closed.

Curved corner partition 30, ninety degree corner partition 31, as well as door partition 7, each preferably have their lowermost edges raised upwardly above floor surface 8 a distance of approximately 3 inches to promote air circulation. Similarly, the uppermost edges of curved corner partition 30, ninety degree corner portion 31, and door partition 7 are each preferably spaced downwardly from the ceiling of the room a distance of at least 2–4 inches to further promote air circulation. Partitions 30, 31 and 7 also preferably have an acoustic construction to attenuate sound transmission both into and out of workspace module 1, particularly when door partition is fully closed. Noise generated within the workspace module 1 by computer equipment, communication devices, sound systems, etc. should not be transmitted readily to the next adjacent workspace module 1, and likewise, sound originating outside of the workspace module 1, such as in an adjacent common area, should not be permitted to flow unimpeded into a closed workspace module, so as to disturb the quiet work of the occupant. Both visual and audio isolation, as well as physical separation or territorial barriers are all important to achieve an environment with sufficient privacy to create a personal workspace module 1 in which knowledge workers can exert maximum concentration efforts, without disturbance, and/or the fear of being interrupted.

The illustrated door jamb partition 32 (FIGS. 9 and 11) comprises an elongate light assembly 58, comprising a perimeter frame 59 with a transparent panel 60 mounted therein. One side 61 of light assembly 58 is attached to a medial portion of the left-hand face of vertical column 14, and the opposite side 62 of light assembly 58 is positioned in-line with vertical column 13, and defines the right-hand side of portal opening 6. The upper edge 63 of light assembly 58 is attached to the lower surface of threshold beam segment 22, so as to create a substantially rigid assembly. A foot or glide 64 is provided at the lower end of light panel side 62 to provide additional support for door jamb partition 32.

Door partition 7 functions as a sliding wall to selectively open and close portal opening 6, and in the illustrated example, has an arcuate plan configuration similar to that of curved corner partition 30. As best illustrated in FIGS. 3 and 4, door partition 7 has a plan shape in the form of an arc, or circle segment with its center located at door support shaft 25, and a radius substantially identical to the length of door support arm 68, which is slightly less than the radius of curved corner partition 30. As best shown in FIGS. 10–13, door partition 7 has a vertical height slightly greater than that of curved corner partition 30, and extends from a point just above the column foot assembly 15 to a point slightly below the associated beam connector 16. Door partition 7 is substantially rigid to facilitate manually shifting the same, and as noted, preferably has an acoustical interior construction to attenuate sound transmission into and out of workspace module 1. Door partition 7 has substantially parallel interior and exterior faces 69 and 70, with squared off side edges 71 and 72, and associated upper and lower edges 73 and 74, respectively.

Door partition 7 is preferably movably suspended from framework 3 on the interior of workspace module 1, and nested against curved corner partition 30 in a manner which permits door partition 7 to be smoothly shifted by manual actuation in a horizontal direction between the fully open position illustrated in FIG. 1, and the fully closed position illustrated in FIG. 2, which motion will not be adversely affected by any uneveness or undulation in the floor surface 8 of the building room. The door partition 7 illustrated in FIGS. 14–17 is slidably suspended on worksurface module 1 in the following fashion. An upwardly opening, channel-shaped upper track 160 is recessed in the upper edge 161 of curved corner partition 30, and extends along a laterally centered portion thereof in an arcuate pattern. A roller assembly 162 is attached to the exterior side 70 of door partition 7, adjacent the upper portion of the rearward or trailing side edge 71 thereof. Roller assembly 162 includes a housing 163 in which a disc-shaped wheel 164 is rotatably mounted for rotation in a generally vertical plane, and protrudes downwardly therefrom, and is received in the upper track 160 in curved corner partition 30. The lower edge 165 of curved corner partition 30 includes a downwardly facing, channel-shaped lower track 166 extending along a laterally centered portion thereof in an arcuate pattern. A guide assembly 167 is attached to the lower edge 74 of door partition 7 adjacent the rearward or trailing side edge 71 thereof, and includes a radially outwardly extending horizontal plate 168, with an upstanding guide pin 169 which is closely received within the lower track 166 on curved corner partition 30. Guide pin 169 may be equipped with a roller (not shown).

Figures 14, 15, 16, 17:
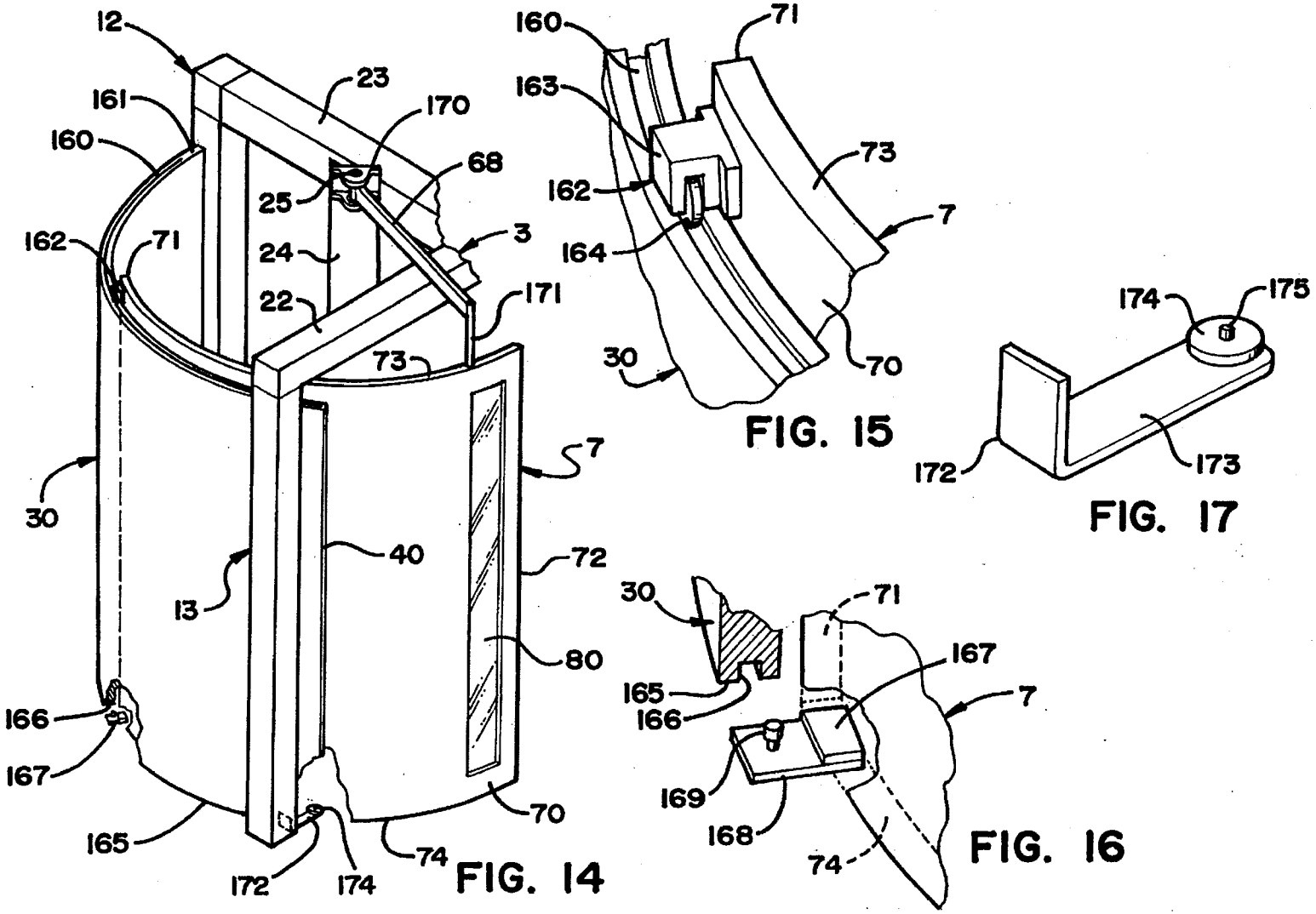
FIG. 14 is a fragmentary, perspective view of the workspace module, with portions thereof broken away to show a door partition support arrangement.
FIG. 15 is a fragmentary, perspective view of an upper roller portion of the door partition support.
FIG. 16 is a fragmentary, perspective view of a lower guide portion of the door partition support.
FIG. 17 is a perspective view of a lower roller portion of the door partition support.
Figure 18:
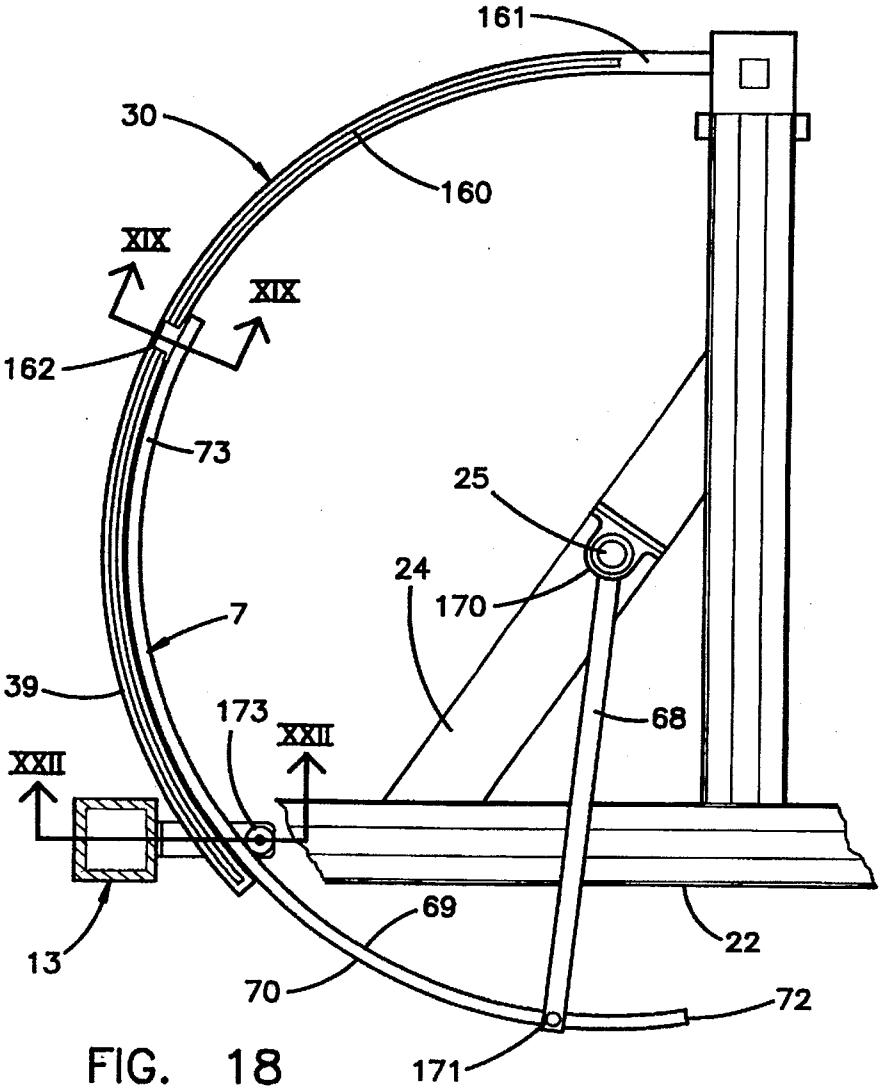
FIG. 18 is a fragmentary, top plan view of the workspace module, particularly showing the door partition support.
Figure 19:
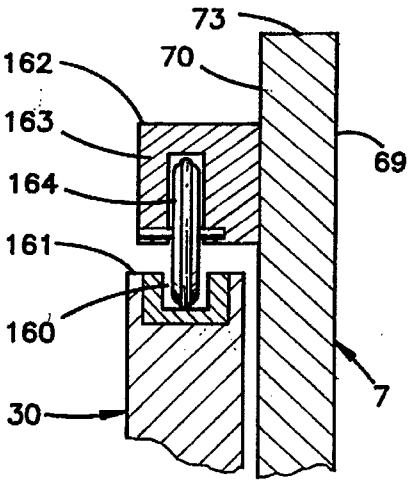
FIG. 19 is a fragmentary, vertical cross-sectional view of the workspace module, taken along the line XIX—XIX, FIG. 18, and showing the upper roller portion of the door partition support.
Figure 21:
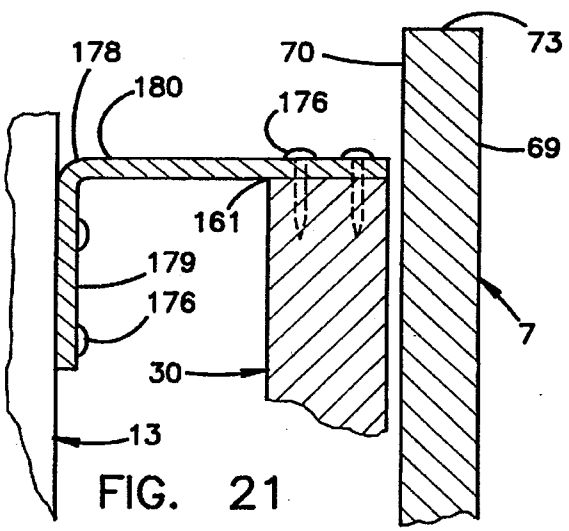
FIG. 21 is a fragmentary, vertical cross-sectional view of the workspace module, taken along the line XX—XX, FIG. 18, and showing an upper panel attachment bracket.
Figure 20:
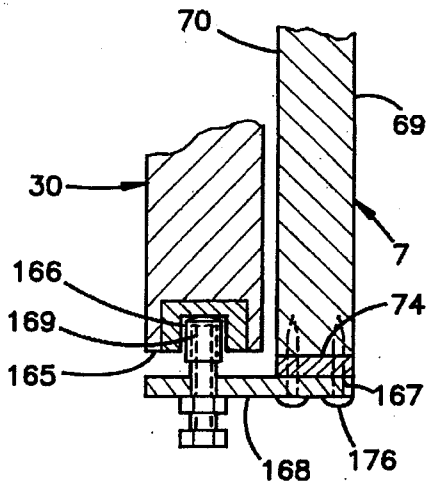
FIG. 20 is a fragmentary, vertical cross-sectional view of the workspace module, taken along the line XX—XX, FIG. 18, and showing the lower guide portion of the door partition support.

In the embodiment illustrated in FIG. 14, bearing shaft 25 is supported in a clevis bracket 170, which is in turn mounted on angle brace 24 to pivotally mount the inner end of arm 68 in a manner which permits arm 68 to rotate in a substantially horizontal plane above framework 3. The outer end of arm 68 includes a downwardly depending support rod 171, which is rigidly attached to the upper edge 73 of door partition 7 at a preselected distance, spaced back from the forward or leading side edge 72 thereof. A vertical support coupling (not shown) may be provided to interconnect support rod 171 and door partition 7, which compensates for any deviations in concentricity about the center of rotation of arm 68, thereby avoiding any binding or stacking when door partition 7 is pivoted. A roller guide assembly 172 is attached to the right-hand face of vertical column 13 by fasteners 176, and protrudes laterally inwardly therefrom.

Figure 22:
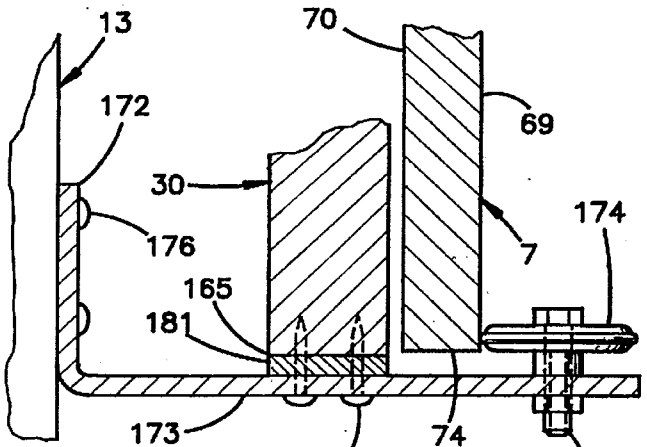
FIG. 22 is a fragmentary, vertical cross-sectional view of the workspace module, taken along the line XX—XX, FIG. 18, and showing the lower roller portion of the door partition support.

Roller guide assembly guide 172 includes an L-shaped bracket 173, with a guide wheel 174 mounted adjacent the outer end thereof by a pin 175 to permit wheel 174 to rotate in a substantially horizontal plane. As best shown in FIG. 22, L-bracket 173 extends underneath the lower edge 165 of curved corner partition 30, and is attached thereto by fasteners 176. L-bracket 173 also extends beneath the lower edge 74 of door partition 7 from which it is vertically separated to position guide wheel 174 at a location adjacent the interior face 69 of door. partition 7. Roller guide assembly 172 may also have a second guide wheel (not shown) positioned to roll against the exterior surface of door partition 7.

With reference to FIGS. 18–22, the forward portion 39 of curved corner partition 30 is attached to vertical column 13 in the following fashion. An upper, L-shaped bracket 178 (FIG. 21) has its vertical leg 179 attached to the right hand face of vertical column 13 by fasteners 176, and its horizontal leg 180 fastened to the upper edge 161 of curved corner partition 30 by like fasteners 176. The lower edge 165 of curved corner partition 30 includes a mounting plate 181, which is in turn fastened to the L-bracket 173 of roller guide assembly 172. In this manner, the forward portion of curved corner partition 30 is suspended above the floor surface 8 on vertical column 13 between brackets 173 and 180.

Door partition 7 has a generally opaque or intransparent construction to provide the interior workspace 5 of workspace module 1 with visual privacy, at least when door partition 7 is fully closed. Preferably, the interior face 69 of door partition 7 incorporates display capabilities, such as a tackable surface, and/or a marker board, or the like, to more effectively support worker activities within workspace module 1. Door partition 7 may also be provided with a lock (not shown) for security purposes, as well as stops (not shown) to positively stop door partition 7 in the fully open and fully closed positions, and handles (not shown) adjacent its opposite side edges 71 and 72.

In operation, door partition 7 can be readily shifted manually in a horizontal or sideways direction between the fully closed position (FIGS. 2 & 4) and fully open position (FIG. 1 & 3) to any intermediate location desired, and in infinitely small increments. As door partition 7 is shifted from the fully closed position (FIGS. 2 & 4) to the fully open position (FIGS. 1 & 3), the leading side edge 72 of door partition 7, along with the forward portion thereof, is supported by rotating arm 68 in a cantilevered fashion. The trailing side edge 71, and associated rearward portion of door partition 70 are rollingly supported by roller assembly 162 in a suspended fashion from the upper track 160 on curved corner partition 30. The guide pin 169 on lower guide assembly 167 translates along the length of the lower guide track 166 in curved corner partition 30 to insure that door partition 7 remains in a generally vertically orientation as it pivots or rotates arcuately about the vertical centerline of shaft 25. The wheel 174 on roller guide assembly 172 contacts the interior surface 69 of door partition 7 as it passes by vertical column 13 to insure that door partition 7 and curved corner partition 30 remain in a mutually parallel relationship, and thereby achieve smooth sliding movement of door partition 7.

A slightly different mounting arrangement for door partition 7 is shown in FIGS. 1–5 and 8–13, wherein instead 0f using clevis bracket 170, door partition support arm 68 includes an annular sleeve 85 (FIG. 2) mounted at its interior end which houses a bearing (not shown) shaped to be received onto upstanding vertical support shaft 25, so as to permit arm 68 to rotate freely about the vertical axis of shaft 25 in a substantially horizontal plane. The mounting of door partition 7 is otherwise identical to the previously described arrangement illustrated in FIGS. 14–22, wherein the exterior end of support arm 68 is similarly attached to the upper edge 73 of door partition 7 by support rod 171, which is located a preselected distance spaced back from the leading side edge 72 of door partition 7 to facilitate complete closure of portal opening 6 when door partition 7 assumes the fully closed position illustrated in FIGS. 2 & 4.

Figure 11:
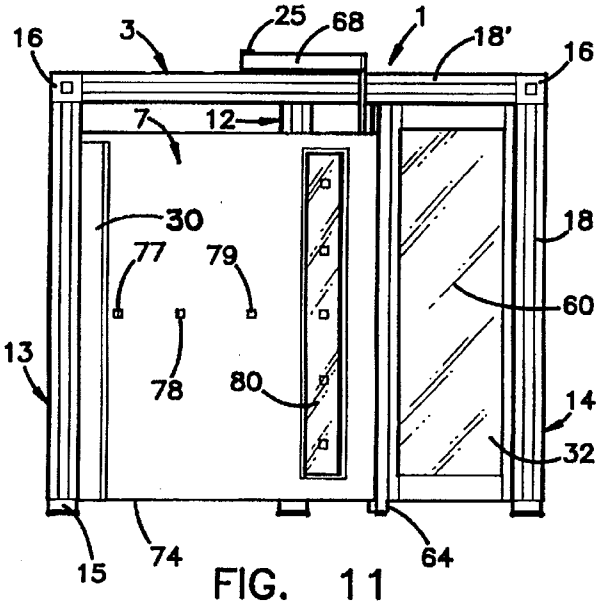
FIG. 11 is a front elevational view of the workspace module, shown with the door partition in its fully closed position.

The illustrated door partition 7 includes an exterior portion which assists in visually indicating in selective increments the relative location of door partition 7 between the fully open position (FIG. 1) and the fully closed position (FIG. 2), so as to facilitate achieving a better balance between worker privacy and worker interaction. In the present example, door partition 7 (FIG. 2) includes a series of relatively small, square, indicator light panels 77–79, which are decorative in nature, and an enlarged, vertically extending light panel 80 positioned adjacent the outer side edge 72 of door partition 7. The smaller square indicator light panels 77–79 are horizontally aligned on door partition 7 at an elevation generally commensurate with the eye level of a seated average adult user, and are spaced regularly apart across the circumference of its exterior face 70. When door partition 7 is fully closed, as illustrated in FIGS. 2 & 11, all indicator light panels 77–80 are exposed, thereby providing a visual indication to passersby and coworkers alike that the occupant of workspace module 1 desires maximum privacy, and does not want to be disturbed. As door partition 7 is shifted from the fully closed position, to the fully open position, indicator light panels 77–80 sequentially retract behind curved corner partition 30, such that fewer indicator light panels 77–80 are exposed, thereby providing a visual indication to passersby and coworkers that the occupant of workspace module 1 desires some lesser, or intermediate degree of privacy, and is available for a limited amount, and/or selected types of worker interaction. When door partition 7 is in the fully open position, as illustrated in FIG. 1, all indicator light panels 77–80, and a major portion of light panel 80 are recessed behind curved corner partition 30, or are at least not readily visible from the front of workspace module 1, thereby providing a visual indication to passersby and coworkers that the occupant of workspace module 1 requires minimum privacy, and is fully available and willing to interact freely.

As best illustrated in FIGS. 3 and 4, curved corner partition 30, door partition 7, and support arm 68 are each positioned so as to cause the leading side edge 71 of door partition 7 to shift or swing forwardly of threshold beam segment 22 as door partition 7 is moved from the fully open position (FIG. 3) to the fully closed position (FIG. 4). As a result of this spatial relationship, shifting door partition 7 Sideways from the fully open position (FIG. 3) to the fully closed position (FIG. 4) increases or expands the amount of interior volume and floor interior space within the workspace module 1 to provide improved freedom of user movement, and to evoke a sense of roominess and comfort. This extra space within the closed workspace module 1 is temporarily captured or borrowed from the common space located immediately outside the portal opening 6. The shifting motion of door partition 7 toward the fully closed position (FIG. 4) also alters the plan shape of the interior space within workspace module 1, which also contributes toward a sense of greater freedom of movement and comfort on the part of the user.

In one working embodiment of the present invention, curved corner partition 30, door partition 7, and support arm 68 are configured to swing the leading side edge 71 of door partition 7, an angle of approximately 80 to 90 degrees with respect to threshold beam segment 22 when door partition 7 is in the fully closed position illustrated in FIG. 4. In this example, workspace module 1 has a footprint length 34 of approximately 8 feet, a minimum footprint width 35 of approximately 5 feet 3 inches, and a framework height of around 7 feet 4 inches, as measured from floor surface 8 to the upper faces of threshold beam segment 22 and cross beam segment 23. Support arm 68 has a length of approximately 3 feet, with support shaft 25 being located horizontally sideways approximately 4–5 inches from the longitudinal center line of cross-beam segment 23, and 17–18 inches horizontally rearwardly from the rear face of threshold beam segment 22. Door partition 7 has a circumferential measure of around 115–120 degrees, and protrudes forwardly of the front face of threshold beam segment 22 approximately 12.5 inches when in its fully closed position.

Figure 7:
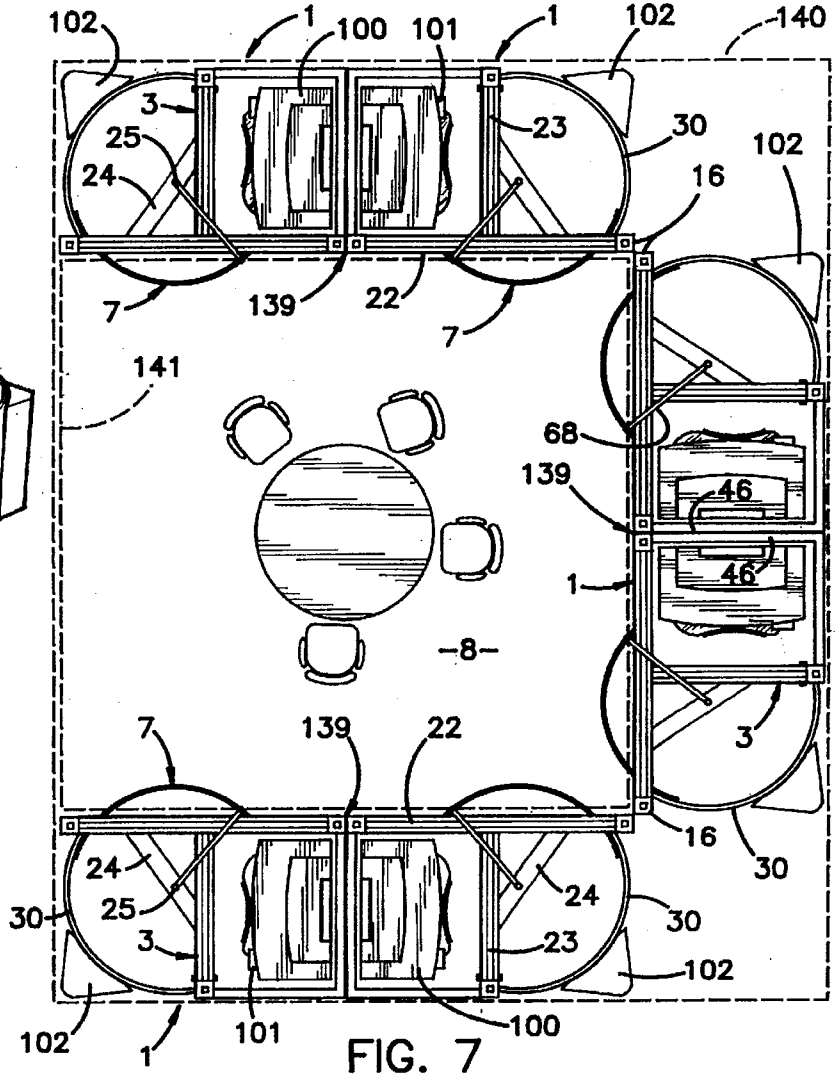
FIG. 7 is a partially schematic, top plan view of a plurality of workspace modules arranged in a U-shaped lay out.
Figure 6:
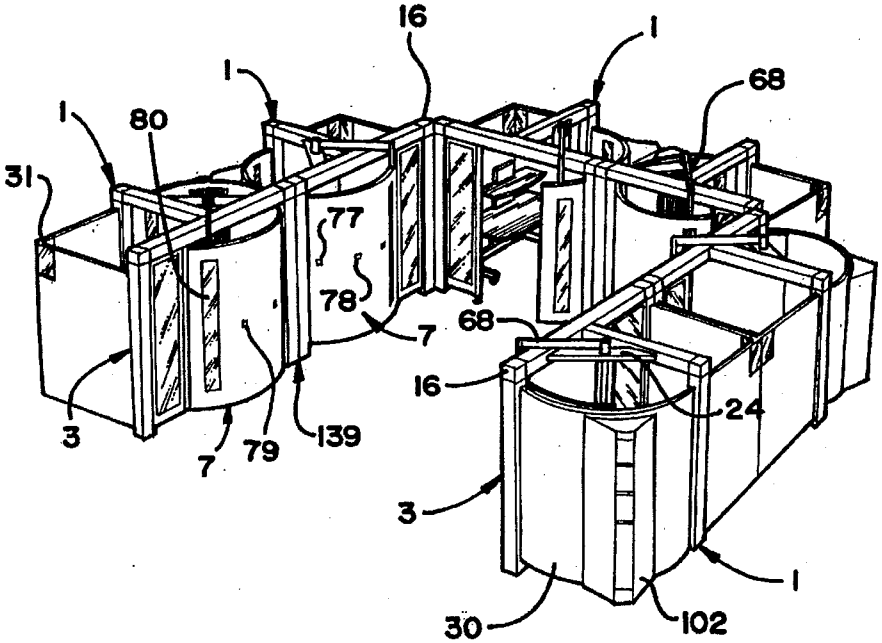
FIG. 6 is a partially schematic, perspective view of a plurality of workspace modules arranged in a U-shaped lay out.

The noted working embodiment of workspace module 1 is a left-handed unit, with door partition 7 and associated support shaft 25 located on the left-hand side of cross-beam segment 23, opposite door jam partition 32. Workspace module 1 may also assume a right-hand unit configuration, as shown in FIGS. 6 and 7, wherein the positions of door partition 7, support shaft 25 and door jamb partition 23 are simply reversed. In both the right and left hand versions of the noted workspace module 1, the interior workspace 5 contains a minimum of approximately 29.6 square feet of floor space, as measured when door partition 7 is in the fully open position (FIGS. 1 & 3). When door partition 7 is shifted into the fully closed position (FIGS. 2 & 4), the interior workspace 5 in workspace module 1 increases by approximately 7.0 square feet, to a total of around 36.6 square feet, by temporarily capturing common space immediately outside portal opening 6. Furthermore, the rectangular footprint 33 which workspace module 1 assumes with door partition 7 in the fully open position (FIGS. 1 & 3) is altered when door partition 7 is closed by adding an arcuate or crescent shaped area, which also serves to further improve freedom of user movement and comfort. The width of portal opening 6 is substantially larger than that of a conventional door opening, and in the illustrated example is in the range of 46–48 inches.

Figure 5:
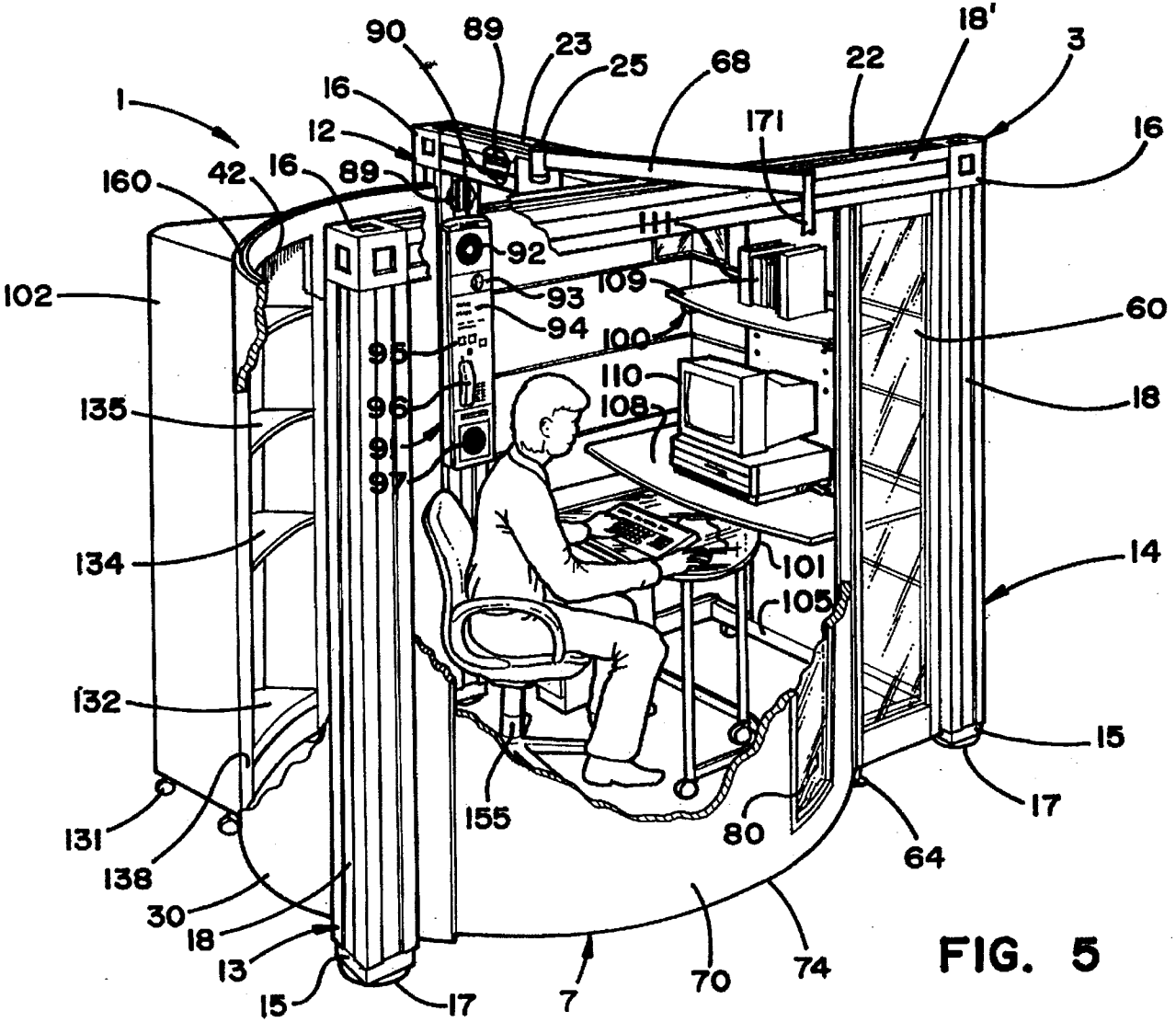
FIG. 5 is a perspective view of the workspace module, shown configured for worker privacy, and with portions thereof broken away to reveal internal construction.

With reference to FIG. 5, workspace module 1 is preferably equipped with both power and signal to better support worker activities, and thereby improve worker efficiency. As previously noted, the vertical columns 12–14 and overhead beam segments 22–23 of framework 3 are hollow, and therefore permit power and signal wires 89 and 90 respectively to be routed therethrough, as well as other types of utilities. In the illustrated example, a plurality of electronic appliances or devices are mounted on the interior face of vertical column 12, and form a control or utility console 91 which includes a fan 92, a clock 93, a thermostat 94, light and fan switches 95, a telephone/fax 96, and a sound system 97. Electronic appliances 92–97 are preferably arranged in a very compact, vertically stacked relationship at a location within workspace module 1, which is both convenient and readily accessible to a seated user, as shown in FIG. 5.

Power outlet receptacles (not shown) may be mounted on any of the faces of vertical columns 12–14, and electrically connected with the power wires 89 routed therein. Also, tasklight units, motion detectors, and other similar powered appliances (not shown) may be mounted on framework 3.

Specially designed auxiliary furniture units 100–102 are also provided to be positioned within the interior of workspace module 1 to improve its operation and use. The illustrated furnishings include a mobile tower or technology cart 100, a mobile table or worksurface 101, and a mobile personal storage unit 102. As illustrated by the different arrangements shown in FIGS. 1–4, auxiliary furniture units 100–102 can be readily moved over the floor surface 8 by the user to adapt workspace module 1 for different types of activities, such as the conferencing arrangement illustrated in FIGS. 1 & 3, and the isolated arrangement illustrated in FIGS. 2 & 4.

Figure 28:
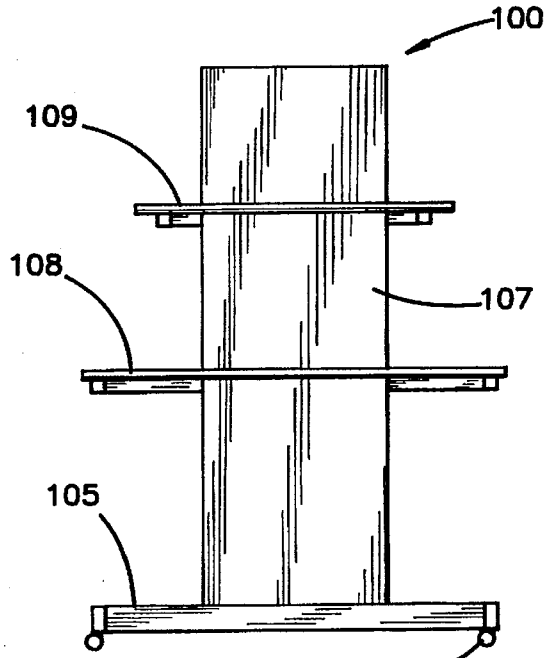
FIG. 28 is a front elevational view of the mobile cart.
Figure 29:
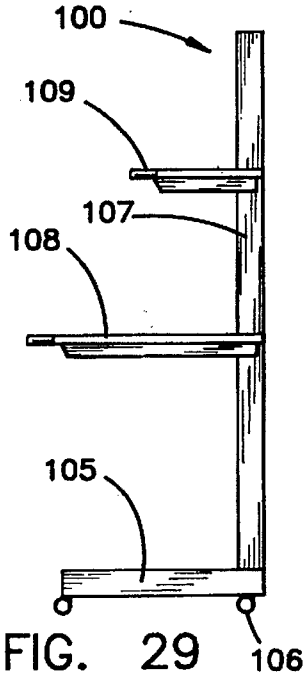
FIG. 29 is a side elevational view of the mobile cart.
Figure 26:
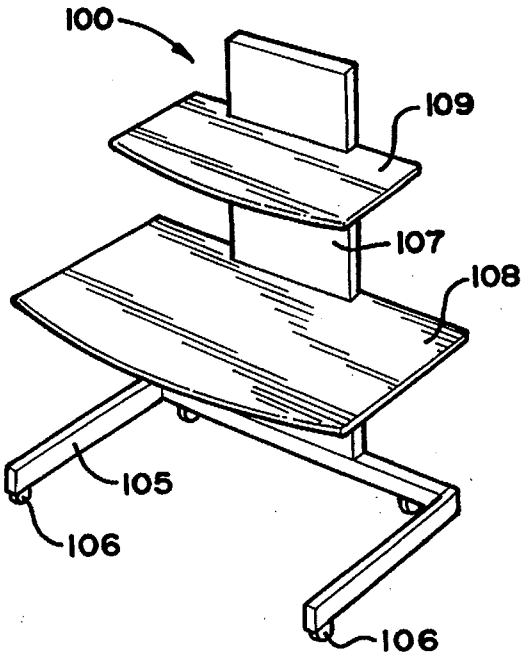
FIG. 26 is a perspective view of a mobile cart especially configured for use with the workspace module.
Figure 33:
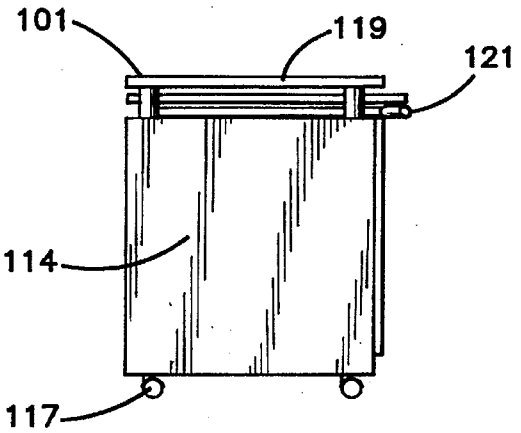
FIG. 33 is a left-hand side elevational view of the mobile worksurface.
Figure 34:
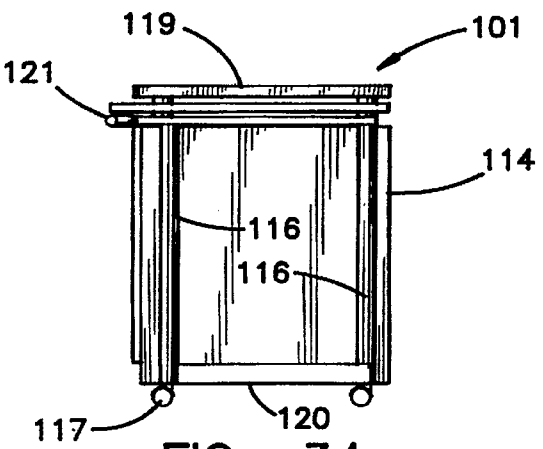
FIG. 34 is a right-hand side elevational view of the mobile worksurface.
Figure 31:
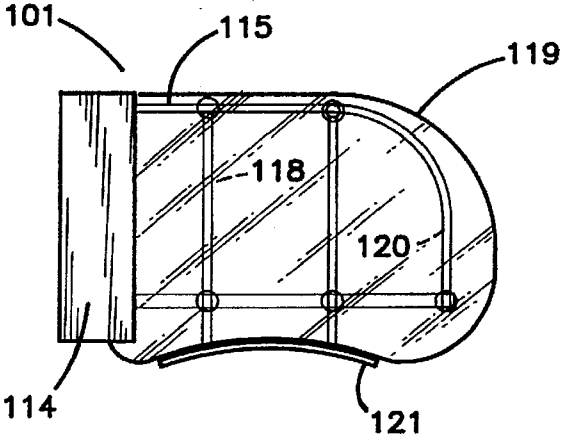
FIG. 31 is a top plan view of the mobile worksurface.
Figure 32:
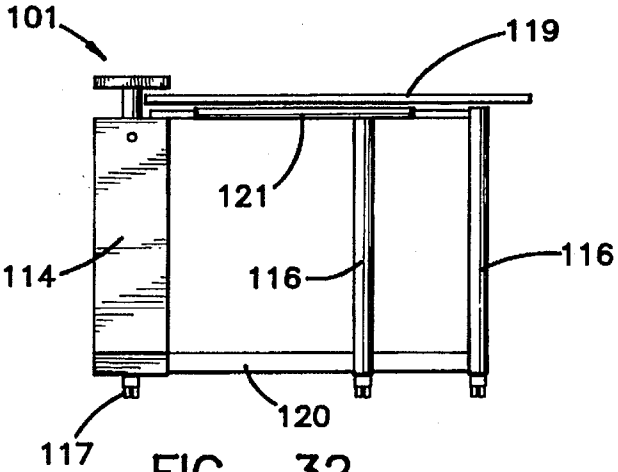
FIG. 32 is a front elevational view of the mobile worksurface.
Figure 30:
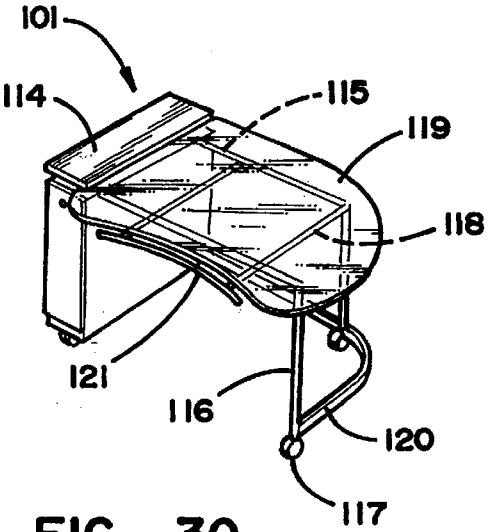
FIG. 30 is a perspective view of a mobile worksurface especially configured for use with the workspace module.
Figure 36:
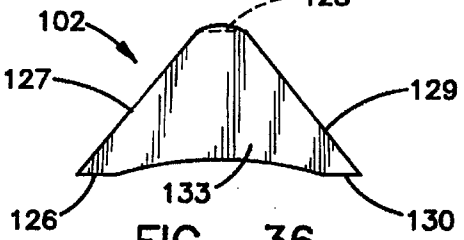
FIG. 36 is a top plan view of the personal storage unit.
Figure 37:
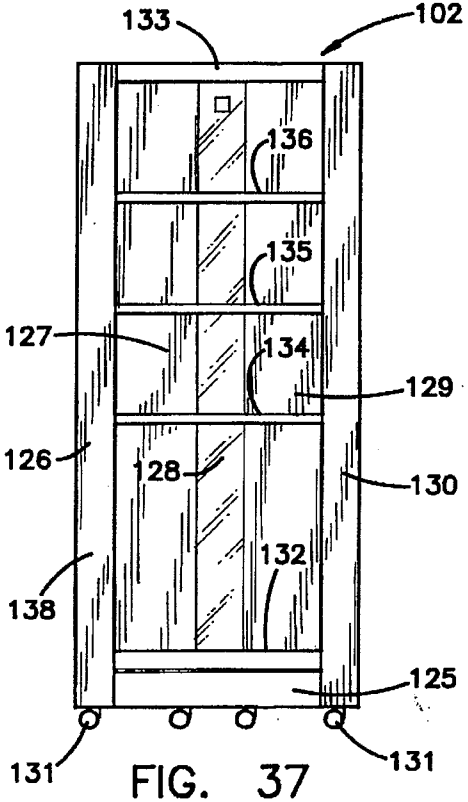
FIG. 37 is a front elevational view of the personal storage unit.
Figure 38:
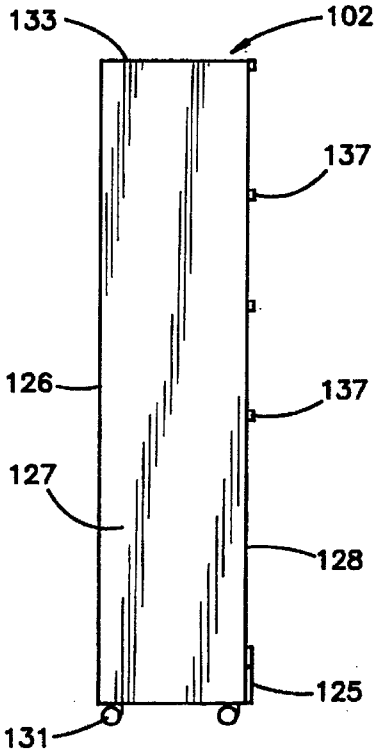
FIG. 38 is a side elevational view of the personal storage unit.

In the example illustrated in FIGS. 26–29, mobile tower or cart 100 includes a U-shaped base 105 having four casters 106 mounted along the lower edge at opposite corners thereof. A vertical support 107 protrudes upwardly from base 105 at a central, medial portion thereof, and supports two horizontal worksurfaces 108 and 109 in a vertically stacked relationship. Vertical support 107 preferably has a hollow construction to permit power and signal cables to be routed therethrough to facilitate supporting electronic equipment on worksurfaces 108 and 109. Lower worksurface 108 is larger than upper worksurface 109, and is particularly-adapted to support thereon electronic and/or technology equipment, such as the computer 110 illustrated in FIG. 5. Upper worksurface 109 is in the shape of a general purpose shelf, and is adapted to support thereon a wide variety of articles, such as the software publications 111 illustrated in FIG. 5. As best illustrated in FIG. 28, the lower worksurface 108 or mobile cart 100 has a lateral or side-to-side width which is slightly larger than the side-to-side width of base 105. With reference to FIG. 3, the overall width of mobile technology cart 100 is slightly less than the distance between panel 47 of 90° corner partition 31, and door jamb partition 32, so as to efficiently use the associated private portion of the workspace module floor space, as explained in greater detail below.

Figure 23:
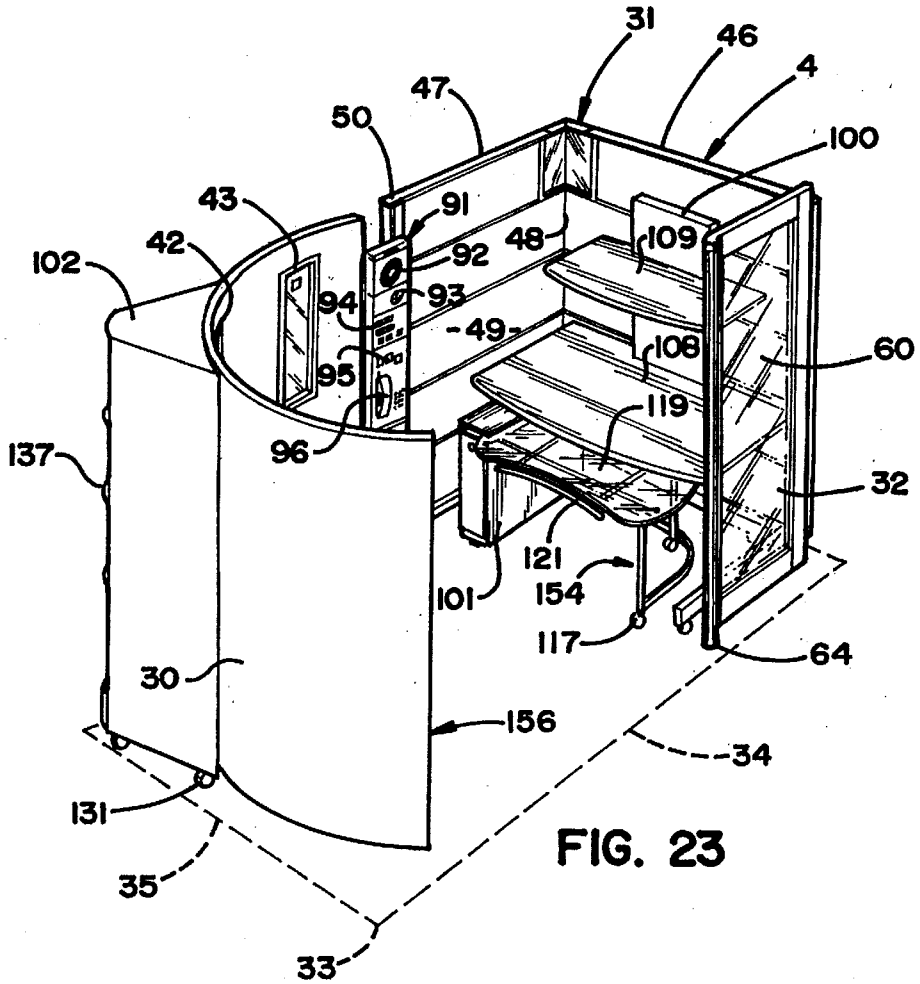
FIG. 23 is a perspective view of the workspace module, shown with the framework removed, and with furniture articles arranged therein.
Figure 27:
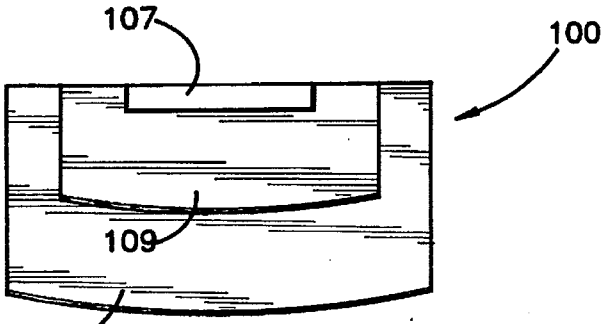
FIG. 27 is a top plan view of the mobile cart.

Mobile table or worksurface 101 (FIGS. 30–34) has an overall shape and size adapted to nest within the base of mobile cart 100 in the manner shown in FIGS. 4, 5 and 23. The illustrated mobile worksurface 101 includes a left-hand storage pedestal 114, with a laterally extending frame 115 attached thereto. Frame 115 includes a pair of vertical legs 116 with casters 117 mounted at their lower ends. A grid shaped support 118 is mounted at the upper ends of legs 116, and supports a bran-shaped worksurface 119, which facilitates conferencing at opposite sides thereof, and in the illustrated example is transparent. An L-shaped brace 120 interconnects the lower ends of legs 116 to provide rigid support for mobile worksurface 101. Casters 117 permit mobile worksurface 1 to be readily transported across the floor surface 8 of the building by the user. A rod-shape handle 121 is mounted on frame 118, and projects forwardly from the front edge of worksurface 119 to facilitate manual positioning of mobile worksurface 101.

The mobile personal storage tower or unit 102 illustrated in FIGS. 35–38 has a generally quadrilateral top-plan configuration, and includes a base 125, and five vertical panels 126–130 upstanding therefrom, which are interconnected along their common edges. Personal storage unit 102 is preferably sized so that it fits within the selected footprint of associated workspace module 1 in the manner best illustrated in FIG. 23, and fills in an otherwise empty corner area of the rectangular footprint. Four casters 131 are mounted on the bottom of base 125, and facilitate translation of mobile personal storage unit 102 across the floor surface 8. A base plate 132 and a top plate 133 are mounted inbetween vertical panels 126–130 at the upper and lower portions of personal storage unit 102, and in the illustrated example, three intermediate shelves 134–136 are also mounted inbetween vertical panels 126–130, and are positioned in a vertically stacked relationship. Personal storage unit 102 is designed to provide bulk storage for a wide variety of different articles, such as books, binders, small appliances, and the like, and may include an integral plug-in power strip (not shown). The personal storage unit 102 illustrated in FIG. 38 includes a series of handles 137 vertically spaced apart on the rear of back panel 128 to facilitate manual translation of storage unit 102 between different locations. Vertical panels 126 & 130, in conjunction with top and base plate 133 & 132, define a rectangular frame assembly 138 on the front face of personal storage unit 102, with an internal opening that is shaped and sized substantially commensurate with the associated opening 42 in curved corner partition 30. For purposes to be described in greater detail hereinafter, the rear wall 128 of personal storage unit 102 is preferably either transparent or translucent, so as to improve lighting in the interior of workspace module 1 when personal storage unit 102 is positioned adjacent thereto.

Workspace module 1 may be readily adapted to effectively and efficiently support a number of different users by providing an individual personal storage unit 102 for each such user. Each user stores in their assigned personal storage unit 102 papers, reports, books, diskettes, and other data and/or personal articles desired. When personal storage units 102 are not in use, they are preferably stored in a locked, secure area (not shown). When a user desires to use workspace module 1, their associated personal storage unit 102 is selected from the secure storage area, and is manually positioned adjacent the exterior side of the curved corner partition 30 on the next available workspace module 1. The selected personal storage unit 102 is oriented with its front face 138 aligned with the elongate opening 42 in curved partition panel 30, such that the interior of personal storage unit 102 is accessible from the interior of workspace module 1 when door partition 7 is in the fully closed position (FIGS. 2 & 4). Since the rearward wall 128 of personal storage unit 102 is transparent, building light, daylight, etc. is transmitted therethrough to improve lighting within the interior of workspace module 1. Detachable latches (not shown) may be provided to positively connect personal storage unit 102 with the associated workspace module 1. When the worker is finished using workspace module 1, the selected personal storage unit 102 may be readily detached from workspace module 1, and manually transported back to the secure storage area, thereby making workspace module 1 available for use by other workers. Mobile worksurface 101 and/or mobile technology cart 100 can similarly be assigned to specific workers, and transported from the secure area to the selected workspace module 1 during use.

Figure 24:
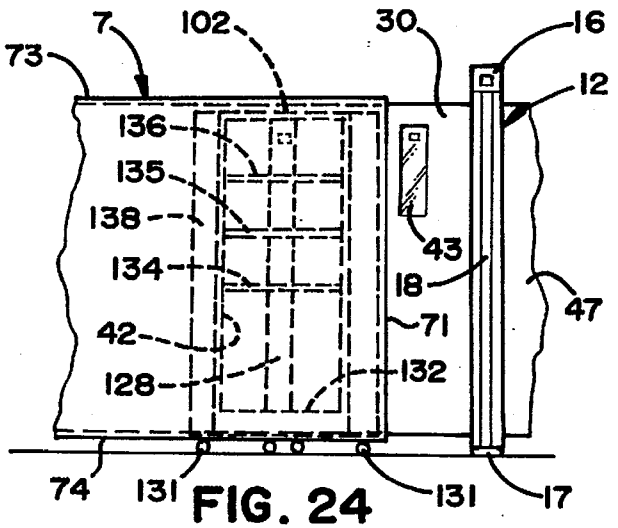
FIG. 24 is a fragmentary, side elevational view of an interior portion of the workspace module, shown with a personal storage unit especially configured for use therewith, and the door partition in its fully open position.
Figure 25:
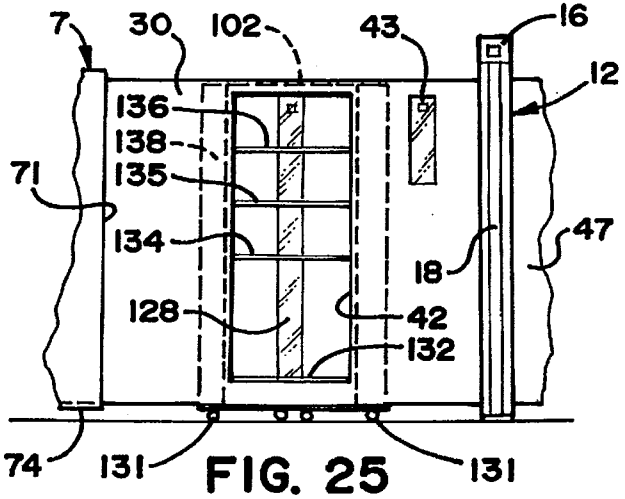
FIG. 25 is a fragmentary, side elevational view of the interior portion of the workspace module, shown with the personal storage unit, and the door partition in its fully closed position.

As previously noted, when door partition 7 is in its fully closed position, the interior of associated personal storage unit 102 may be readily accessed through panel opening 42, as shown in FIG. 25. When door partition 7 is shifted toward its fully open position, the trailing side edge 71 of door partition 7 passes over partition opening 42, such that when door partition 7 is fully open, as shown in FIG. 24, door partition 7 covers partition opening 42, and blocks access to personal storage unit 102. In this manner, personal articles contained in storage unit 102 are automatically hidden from view by passersby when door partition 7 is fully open. As door partition 7 is closed, partition opening 42 is automatically uncovered to provide free access to storage unit 102 from the interior of workspace module 1.

The interior workspace 5 of workspace module 1 illustrated in FIGS. 3 and 4 is arranged in a preferred. manner, as outlined below. The door jamb partition 32 at the right hand side of portal opening 6 creates a private area in the nook 154 within workspace 5 that is particularly adapted for quiet work. Mobile technology cart 100 is positioned in nook 154, with its vertical support 107 positioned adjacent panel 46. When isolated work is being performed with door partition 7 fully closed, mobile worksurface 101 is also preferably positioned in nook 154, with at least the rearward portion thereof nested underneath mobile technology cart 100, as shown in FIG. 4. Nook 154 thereby includes a worksurface region 157 of interior workspace 5. A castered chair 155, preferably of the swivel/synchrotilt type, is positioned in a seating region 150 of workspace 5, disposed directly in front of nested worksurface and cart units 101 and 100. When a user seated in chair 155 is working at worksurface unit 101, as shown in FIG. 5, the utility console 91 is located immediately adjacent the left side of the user for convenient manipulation and operation of appliances 92–97. Also, mobile worksurface 101 is drawn partially outwardly toward the seated user from underneath mobile cart 100 to expose the desired amount of bean-shaped worksurface 119 for writing and/or keyboarding. The mobility and nested construction of mobile cart 100 and mobile worksurface 101 assists the user in achieving the desired balance between raised worksurface areas, and free floorspace over which chair 155 can be translated. The area between chair 155, utility console 91, and mobile cart and worksurface 100 & 101 define an efficient work triangle, which provides unobstructed access when the user is either seated or standing.

The remainder of interior workspace 5 (FIGS. 4 & 5) creates a general purpose activity area 156 about which the seated user can manipulate chair 155 to readily access articles within personal storage unit 102, documents packed on the interior surface of door partition 7 and/or curved corner partition 30, etc. While horizontal storage within workspace module 1 is somewhat limited, vertical storage on partitions 7 & 30–32, and vertical columns 12–14, such as utility console 91, is readily available. When conferencing activities are desired with door partition 7 fully open, mobile worksurface 101 may be moved from underneath technology cart 100 to a location just outside of portal opening 6, as shown in FIG. 3, with castered chairs 155 positioned on opposite sides thereof to facilitate two-party conferencing, and the like. The curvature of door partition 7 is selected to particularly cooperate with castered swivel chair 155, such that when chair 155 is positioned adjacent the center of rotation of door partition 7, as illustrated in FIG. 3, a seated user can readily translate door partition 7 sideways by simply pivoting in chair 155, while moving door portion 7 in a similar arcuate direction.

When the occupant of workspace module 1, as seated in castered chair 155, desires an environment for quiet work, the worker may simply scoot their chair 155 over the floor surface 8 to a position generally underneath shaft 25, and grasp an adjacent portion of door partition 7, and then urge upon the same to shift the door partition 7 sideways in an arcuate fashion to a closed position commensurate with that degree of privacy the user desires. Because the curvature of door partition 7 is selected in cooperation with the swivel motion of castered chair 155, the shifting motion of door partition 7 in either direction is quite convenient for the seated user, and requires minimum movement and/or effort.

If the user plans on high levels of concentration and/or creativity, door partition 7 is preferably shifted to the fully closed position (FIGS. 2 & 4). As the seated user shifts door partition 7 toward the closed position, portal opening 6 is closed off, and the workspace module 1 closes about or envelopes the seated occupant, thereby imparting to the occupant a strong psychological sense of seclusion and privacy, achieved largely through visual and audio isolation, as well as physical separation or territorial barriers between the user and the rest of the office plan. Any feelings of closeness or claustrophobia, which are sometimes associated with such strong senses of separation and seclusion in a restricted space, are suppressed or subdued by the contemporaneously expanding space, and dynamic shape changes which take place within the workspace interior 5, as door partition 7 is swung closed. This increasing size and changing shape tend to evoke in the user a sense of roominess and comodiouness, which creates a very comfortable environment that fosters worker productivity. The exposure of the interior surface of curved corner portion 30, and the addition of extra space, and associated personal articles in personal storage unit 102, also serve to allay feelings of closeness, and promote user comfort. Each of these changes also serves to more effectively support the user, by providing additional space, and equipment. The resultant environment for the seated occupant of workspace module 1 is a unique alcove feeling, which has heretofore been unavailable and unachievable in conventional systems furniture or modular furniture arrangements.

When the seated occupant of workspace module 1 desires to terminate quiet work, and undertake worker interaction, door partition 7 is similarly shifted sideways in an opposite direction to an open position commensurate with that degree of coworker involvement the user desires. In the event full interaction is desired, door partition 7 is preferably shifted to the fully open position (FIGS. 1 & 3). As the seated user shifts door partition 7 toward the open position, portal opening 6 is opened up, and exposes the seated user and certain portions of the workspace interior. Displays and/or information on the interior surface of curved corner partition 30, as well as articles within personal storage unit 102 are automatically covered by door partition 30, and remain out of view to coworkers and passersby.

Figure 40:
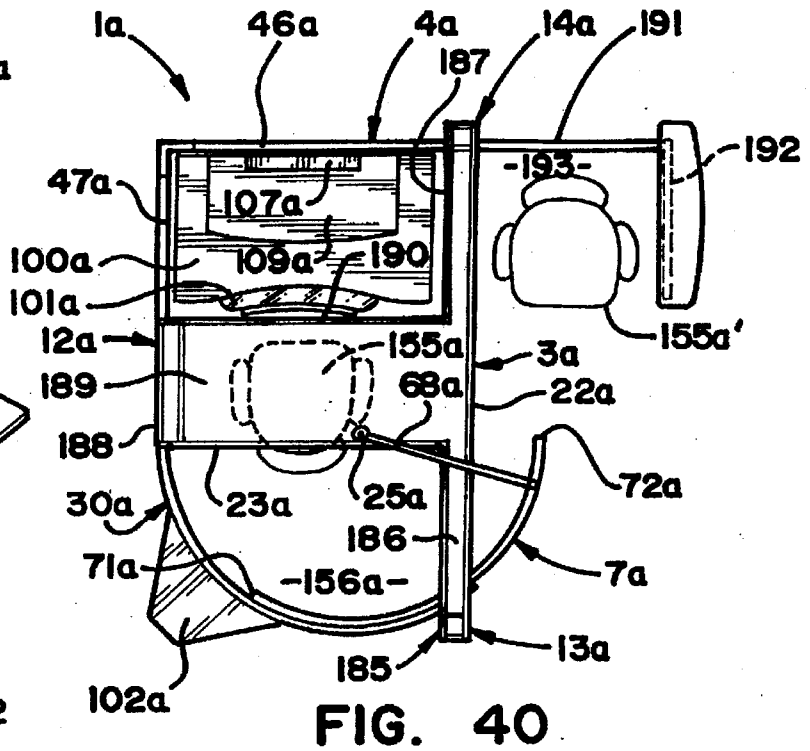
FIG. 40 is a top plan view of the workspace module shown in FIG. 39.
Figure 39:
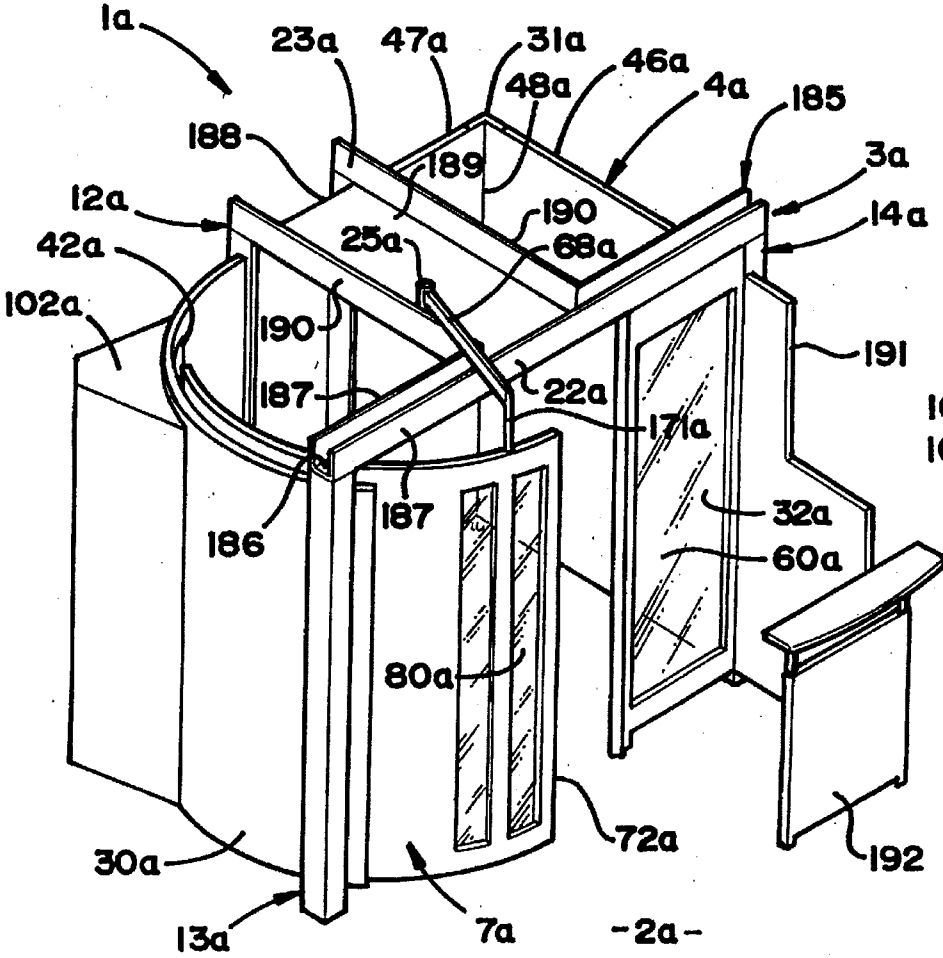
FIG. 39 is a perspective view of another embodiment of the workspace module, having a T-channel framework, and an outrigger partition with a transaction height worksurface.

The reference numeral 1*a* (FIGS. 39 & 40) designates another embodiment of the present invention, having a T-channel framework 3*a*. Since workspace module 1*a* is similar to the previously described workspace module 1, similar parts appearing in FIGS. 1–38 and FIGS. 39 & 40 respectively are represented by the same, corresponding reference numeral, except for the suffix "a" in the numerals of the latter. In workspace module 1*a*, framework 3*a* is in the form of an upwardly opening channel 185, having a generally T-shaped plan configuration. Threshold beam segment 22*a* is channel shaped, comprising a web 186 with a pair of side flanges 187 upstanding from opposite sides thereof, and spaced apart a distance substantially equal to the width of associated vertical columns 13*a* and 14*a*. Instead of a post construction, vertical column 12*a* is in the form of a relatively wide, vertically oriented U-shaped channel 188, which opens at its top to cross-beam segment 23*a*. Cross beam segment 23*a* is also in the form of an upwardly opening U-shaped channel, having a web 189, and a pair of upstanding side flanges 190. The channel shape of framework 3*a* greatly facilitates routing wires and other utilities throughout workspace module 1*a*. In one working embodiment of workspace module 1*a*, cross beam side flanges 190 are spaced apart a distance in the range of 1 to 2 feet, preferably around 23 inches, such that the support shaft 25*a* for cantilevered door partition support arm 68*a* is mounted directly on the web 189 of framework 3*a*. The additional width of cross-beam segment 23*a* provides a canopy effect directly over the seated user, and also provides additional space on vertical column 12*a* on which various utilities can be mounted immediately adjacent the left hand-side of the seated user. Workspace module 1*a* further includes two outrigger partition panels 191 and 192, which are attached to vertical column 14*a*, and extend therefrom in an L-shaped pattern, so as to create a three-sided space or front porch 193 in which a visitor chair 155*a*' may be positioned.

Figure 42:
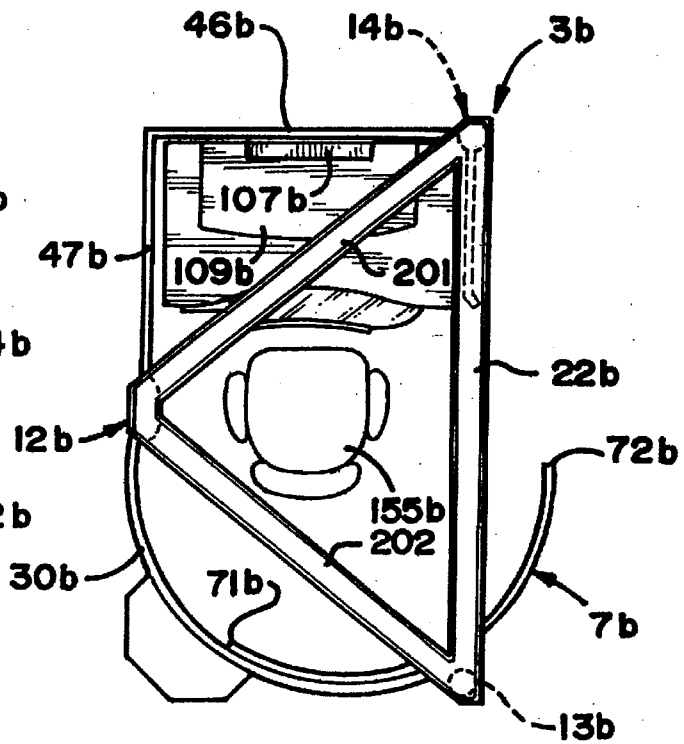
FIG. 42 is a top plan view of the workspace module shown in FIG. 41.
Figure 41:
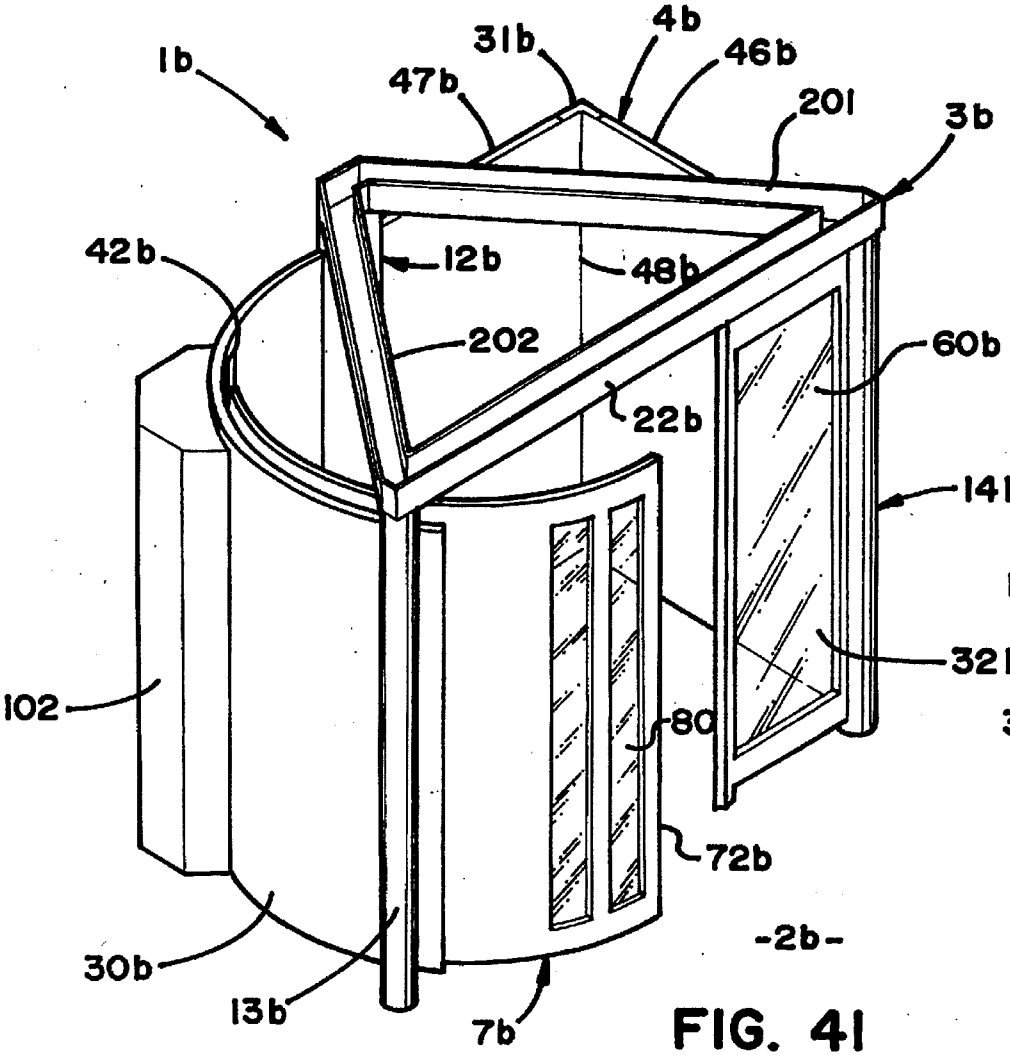
FIG. 41 is a perspective view of yet another embodiment of the workspace module, having a triangle-channel framework.

The reference numeral 1*b* (FIGS. 41 & 42) generally designates yet another embodiment of the present invention, having a triangular channel framework 3*b*. Since workspace module 1*b* is similar to the previously described embodiments 1 and 1a , similar parts appearing in FIGS. 1–38 & 39–40, and FIGS. 40–42 respectively are represented by the same, corresponding reference numeral, except for the suffix "b" in the numerals of the latter. The framework 3*b* associated with workspace module 1*b* includes three upwardly opening U-shaped channels, comprising threshold beam segment 22*b*, and two angle beam segments 201 and 202, which are arranged in an equilateral triangular plan configuration instead of the T-shaped configuration of frameworks 3 and 3*a*. Like U-shaped framework 3*a*, the framework 3*b* of workspace module 1*b* facilitates routing of wires, cables, and other utilities therethrough to provide power and signal to workspace module 1*b*.

The reference numeral 1*c* (FIG. 43) generally designates yet another embodiment of the present invention, having a four-post framework 3*c*. Since workspace module 1*c* is similar to the previously described embodiments 1 and 1a–1b, similar parts appearing in FIGS. 1–38 & 39–42, and FIG. 43 respectively are represented by the same, corresponding reference numeral, except for the suffix "c" in the numerals of the latter. Workspace module 1*c* includes a fourth vertical post or column 205, which is positioned in-line, and opposite vertical column 12*c*. A beam connector 16*c* is mounted on the upper end of column 205, and supports one end of an extension beam segment 206, which extends horizontally therefrom to threshold beam segment 22*c*, and is fixedly attached to a central portion thereof, opposite cross-beam segment 23*c*. Vertical column 205 is substantially identical to the other three vertical columns 12*c*–14*c*, and is positioned relative thereto such that overhead frame 11*c* has a generally "x" shaped plan configuration, wherein cross beam segment 23*c* and extension be segment 206 are oriented mutually in-line and substantially perpendicularly to threshold beam segment 22*c*. The fourth vertical column 205 serves to expand the footprint 33*c* of workspace module 1*c* by capturing space disposed immediately outside of portal opening 6 to define a front porch space 207, which can be used for storage, visitor conferencing, or the like. In one working embodiment of workspace module 1*c*, the fourth vertical column 205 is positioned from threshold beam segment 22*c* a distance which enlarges the length 34*c* of the workspace module footprint 33*c* to 10 feet, while the width 35*c* of the workspace module footprint 33*c* remains unchanged at 8 feet.

Figure 44:
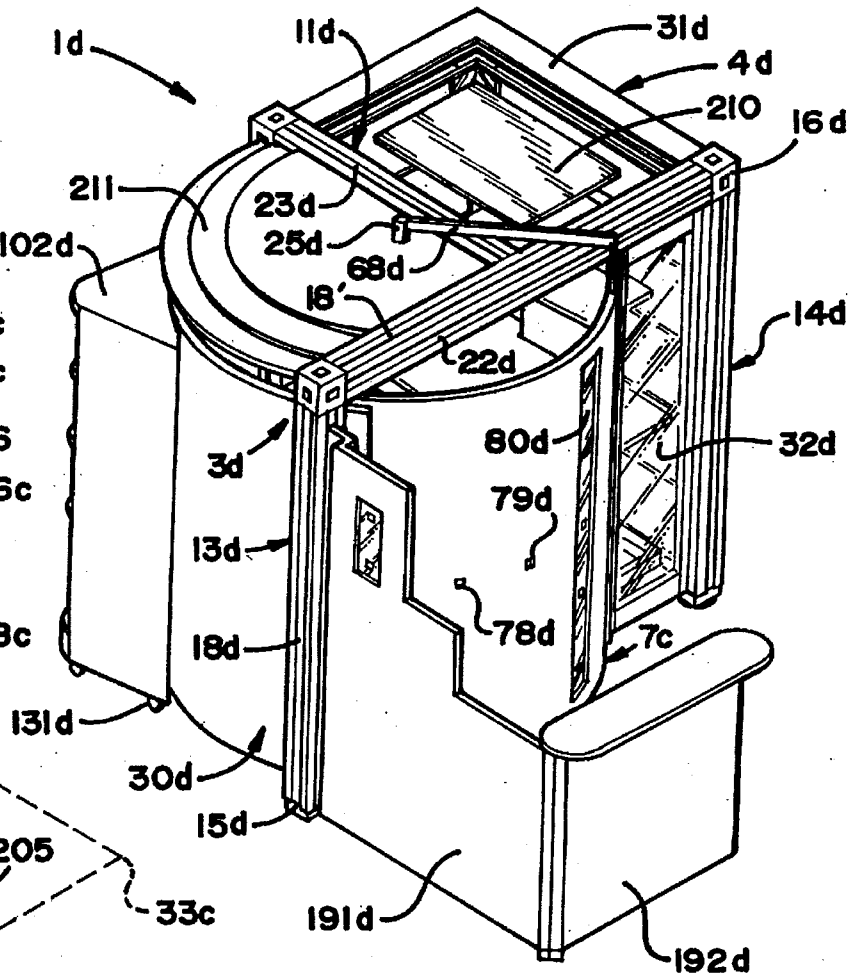
FIG. 44 is a perspective view of yet another embodiment of the workspace module, having ceiling panels, and an outrigger partition with a transaction height worksurface.

The reference numeral 1*d* (FIG. 44) generally designates yet another embodiment of the present invention, having ceiling panels 210 and 211. Since workspace module 1d is similar to the previously described embodiments 1 and 1a–1c, similar parts appearing in FIGS. 1–38 & 39–43, and FIG. 44 respectively are represented by the same, corresponding reference numeral, except for the suffix "d" in the numerals of the latter. Workspace module 1*d* includes a rectangular ceiling panel 210 mounted directly over the private portion or nook 154 of interior workspace 5*d*, and is centered within the rectangular space, defined by threshold beam segment 22*d*, cross-beam segment 23*d*, and ninety degree corner partition 31*d*. Rectangular ceiling panel 210 is preferably positioned at a height substantially commensurate with overhead framework 11*d*, and is sized substantially smaller than the associated rectangular space, so as to provide substantial passages through the top of workspace module 1*d* for air circulation.

An arcuate ceiling panel 211 is positioned directly over the general activity portion 156 of interior workspace 5*c*, within the space defined by threshold beam segment 22*d*, cross-beam segment 23*d* and curved corner partition 30*d*. Arcuate ceiling panel 211 is also positioned at an elevation substantially commensurate with overhead framework 11*d*, and has a louvered or vertically stacked construction, which permits the free low of air therethrough for improved ventilation within workspace module 1*d*, even when door partition 7*d* is fully closed. Ceiling panels 210 and 211 provide additional privacy to workspace module 1*d* by increasing visual and audio isolation, as well as an overhead barrier. The door support shaft 25*d*, and associated interior end of cantilevered door support arm 68*d* are attached directly to arcuate ceiling panel 211.

With reference to FIGS. 6 and 7, each of the above-described types of workspace modules 1–1*d* is particularly adapted to be used in groups or clusters, so as to create an integrated officing arrangement for open plans, and the like. In the examples illustrated in FIGS. 6 and 7, six workspace modules 1 are arranged in a generally U-shaped plan configuration, which includes three sets 139 of matched right and left-hand units, arranged with associated partition panels 46 facing one another. Each set 139 of right and left-hand workspace modules 1 is oriented in a mutually perpendicular relationship with the next adjacent set 139.

In FIG. 7, the floor surface 8 of the building or room is defined by a set perimeter, indicated by the broken line 140. Each set 139 of workspace modules 1 is positioned with their rearward sides (i.e. partition panels 30 and 47) disposed along the perimeter 140 of floor surface 8, and their portal openings 6 facing inwardly toward the central portion of the floor surface 8 to define a common workspace, indicated by the broken line 141. As previously noted, each workspace module 1 has an identical footprint 33, even when a personal storage unit 102 is attached thereto, so as to greatly facilitate space planning. When the door partitions 7 of workspace modules 1 are fully open, the amount of common workspace 141 is maximized for collaborative coworker activities. When the door partitions 7 of workspace modules 1 are fully closed, as shown in FIG. 7, the cumulative amount of private space is maximized for individual worker activities. Hence, while the total amount of floor space required for the office cluster remains constant, the amount of this floor space which is dedicated to common workspace and private workspace varies depending upon the users' needs for collaborative and/or individual work activities.

Conventional workstations, such as those formed by partition panels and/or modular furniture units, have traditionally been alloted on average around 80 square feet of floor space for each workstation. As previously noted, this space is normally required to support both individual work activities, as well as at least some types of group activities, such as inter-office conferences. Since the footprint for each workspace module 1 is only 36.6–42.0 square feet, depending upon whether door partition 7 is fully open or fully closed, by comparison with a conventional workstation, approximately one-half, or between 38–43.4 square feet of floor space can be contributed by each such workstation location to a common area for collaborative activities, without increasing the total amount of floor space required to support an equal number of workers. Hence, workspace modules 1 provide the office designer and specifier with a new resource to more efficiently and cost effectively support workers.

Figure 43:
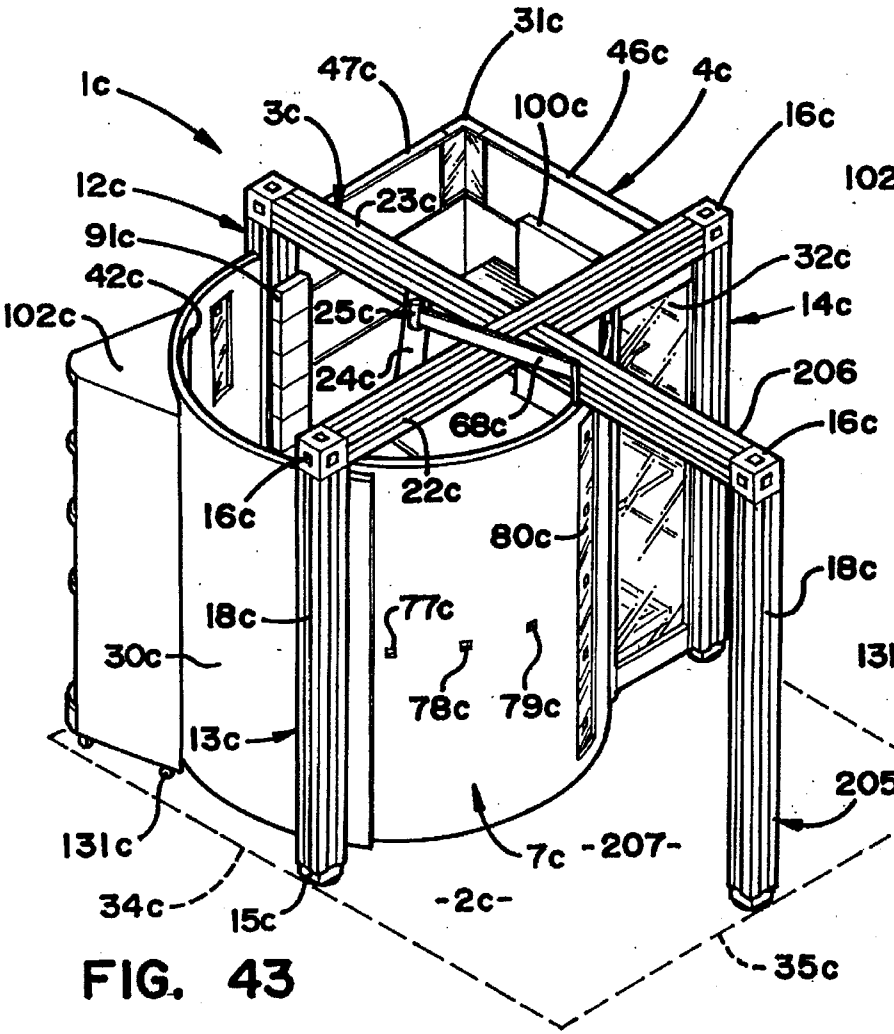
FIG. 43 is a perspective view of yet another embodiment of the workspace module, having a four-post framework.
Figure 45:
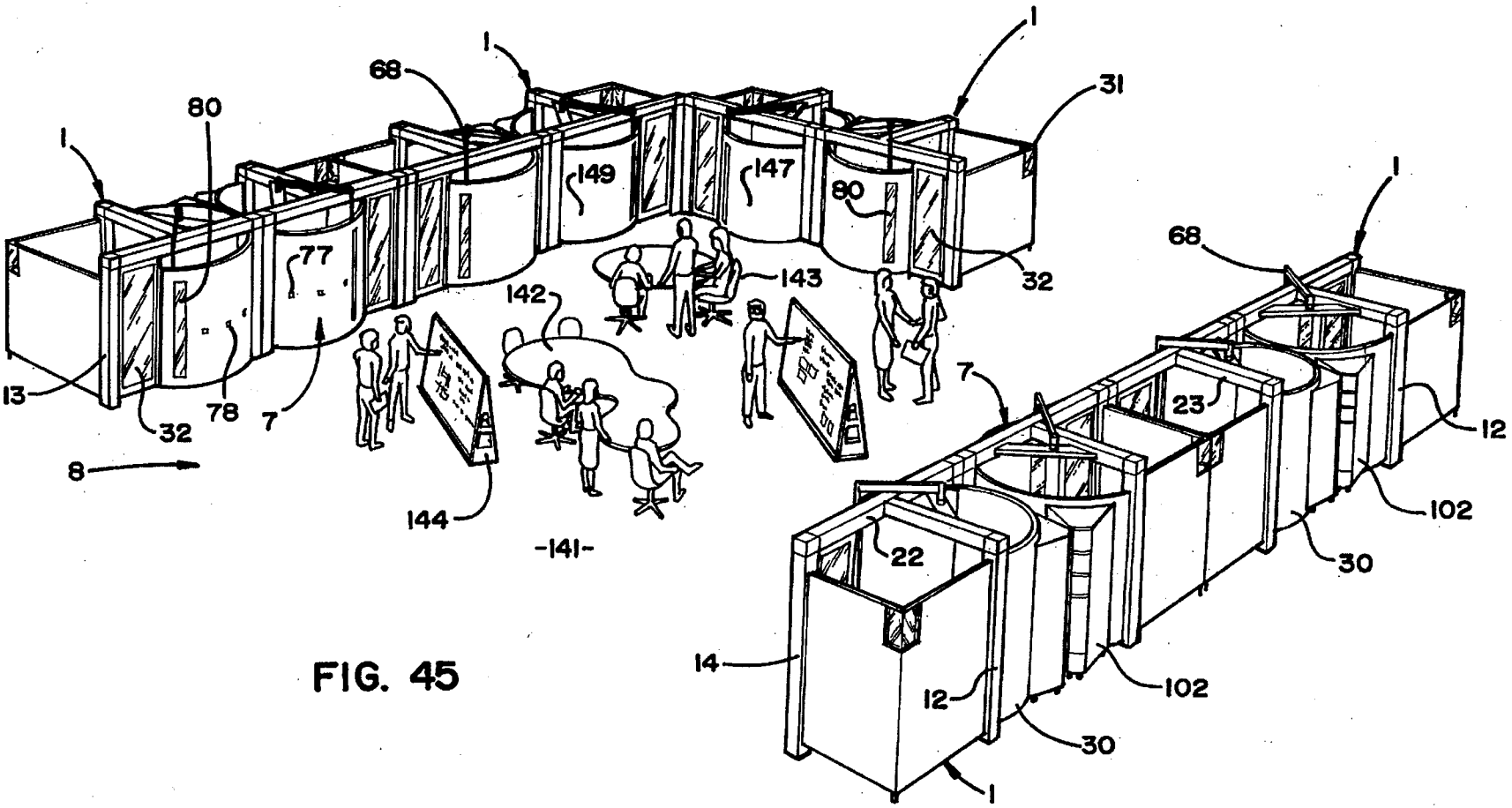
FIG. 45 is a perspective view of an office arrangement including a plurality of workspace modules arranged in two clusters, and a furniture positioned in a common area framed by the clusters of workspace modules.

Another arrangement of workspace modules 1 is shown in FIG. 45, wherein the common workspace 141 is provided with furnishings, such as the illustrated tables 142, chairs 143, and mobile displays 144. This arrangement of common workspace 141 is particularly adapted to support group meetings, and the like, typically of those workers assigned to the workspace modules 1 positioned adjacent to the common workspace 141. When the door partition 7 of one of the workspace modules 1 is swung to the fully open position, the lack of a threshold and/or lintel about door partition 7, as well as the extra width of portal opening 6, causes the private workspace within the interior of workspace module 1 to flow directly and homogeneously into, and thereby become annexed to the common workspace 141. Hence, the user can experience some degree of interaction with coworkers, even when the user is located wholly within their own workspace module 1. By locating workspace modules 1 overlooking a common workspace 141, as shown in FIG. 43, the common workspace 141 provides the workspace module worker with a refreshing buffer environment, substantially clear of vertical obstructions, which contrasts to, yet positively augments or enhances the enclosed intense working environment provided when workspace module 1 is used with door partition 7 fully closed.

Figure 46:
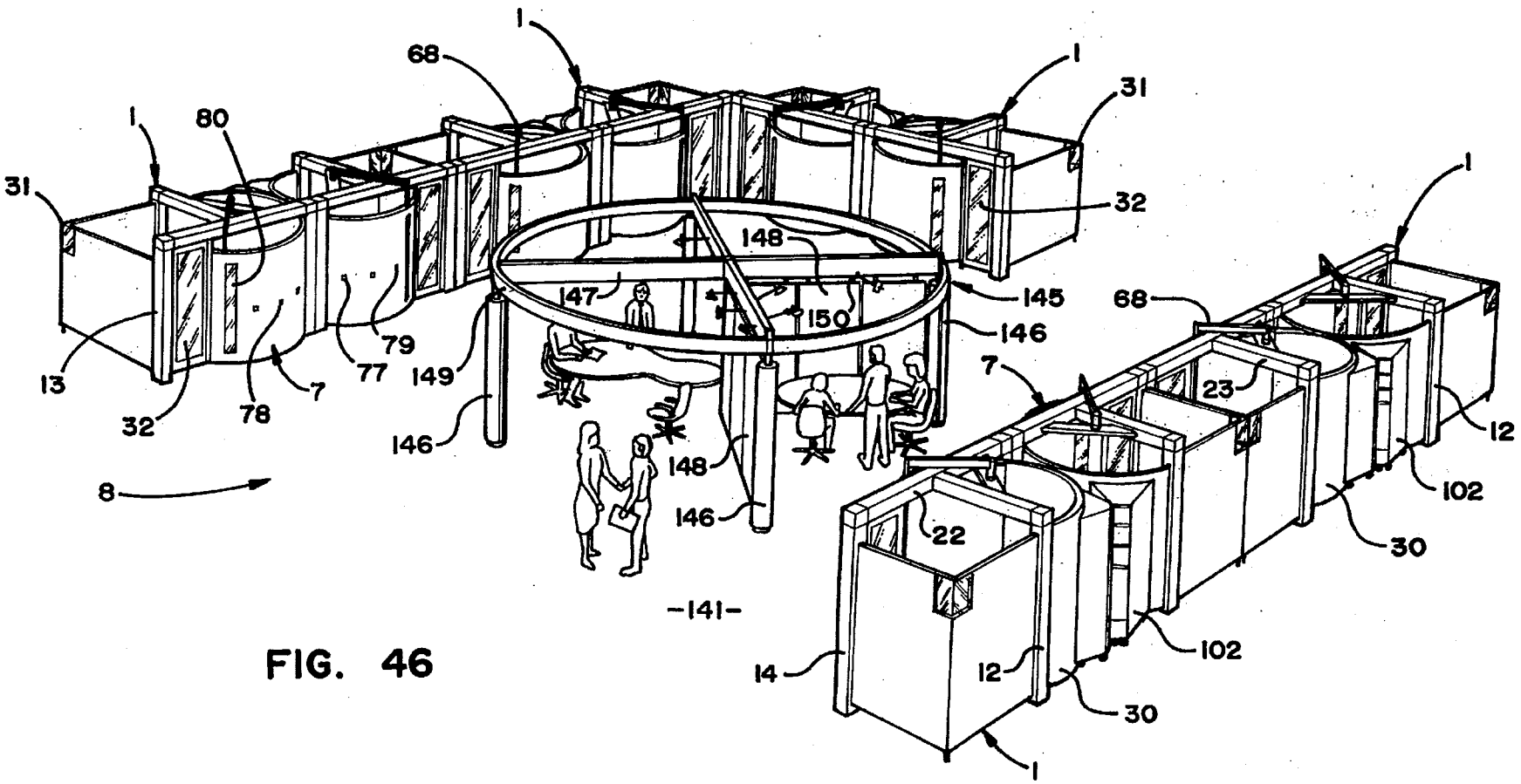
FIG. 46 is a perspective view of an office arrangement including a plurality of workspace modules arranged in two clusters, and a furniture system positioned in a common area framed by the clusters of workspace modules, wherein the furniture system is configured to define two, smaller subgroup workspaces for breakout-type activities.

With reference to FIG. 46, a cluster of workspace modules 1 is shown configured in a predetermined arrangement on building floor surface 8, with a unique furniture system 145 positioned in the common workspace 141 thereof to assist in further supporting group work activities. Furniture system 145 is the subject of commonly assigned, co-pending U.S. patent application Ser. No. 774,563 filed Oct. 8, 1991 entitled FURNITURE ARRANGEMENT, which is incorporated herein by reference. The illustrated furniture system 145 comprises a plurality of posts or columns 146 which support an overhead framework 147 on the floor surface 8 of the open office space in a freestanding fashion at a predetermined elevation, generally above average user height. A plurality of individual panels 148 are provided, wherein each panel 148 is constructed to permit easy, manual bodily translation of the same by an adult user. A hanger arrangement 149 is associated with overhead framework 147, and cooperates with connectors 150 on panels 148 to detachably suspend panels 148 at various locations along overhead framework 147. Panels 148 are manually reconfigurable between many different arrangements, such as the configurations shown in FIGS. 45 and 46, to efficiently and effectively support different group work activities. Preferably, panels 148 are capable of providing a partitioning function to visually divide at least a portion of the workspace, and/or a display function to facilitate group communications.

Furniture system 145 is particularly adapted for use in conjunction with a cluster of workspace modules 1, particularly when supporting group work activities, so as to create a complete office plan or neighborhood. Furniture system 145 is designed to support group meetings of a problem-solving team, as well as to accommodate smaller breakout group discussions, as shown in FIG. 46. When the team members require individual effort, they may perform such tasks in their assigned workspace modules 1, which are preferably positioned about the perimeter of floor surface 8. By manually varying the position of door partitions 7 of workspace modules 1, the users can achieve a proper balance between worker interaction and worker isolation.

While workspace modules 1–1*d* are shown herein as installed in open plan spaces, it is to be understood that they may also be used in many other environments and applications. For example, workspace modules 1–1*d* may be used in airports, train stations, libraries, etc. as either temporary or a permanent office.

Workspace module 1 provides a compact and dynamic environment that is particularly adapted to efficiently and effectively support knowledge workers involved in team problem solving techniques. The door partition 7 and adjacent fixed partitions 30–32 are arranged, such that shifting the door partition 7 from its fully open position (FIGS. 1 & 3) to its fully closed position (FIGS. 2 & 4) not only increases the amount of interior space within workspace module 1, but also alters its plan shape, and exposes panel surfaces and appliances to provide both improved freedom of user movement and worker support, and a sense of roominess and comodiousness. Each workspace module 1 has a unitary type of construction, and a predetermined footprint, which greatly facilitate space planning. The personal storage units 102 adapt each workspace module 1 for use by multiple users, while maintaining a sense of user ownership.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An office arrangement for open plan spaces and the like of the type having a building floor with a predetermined floor area defined by a set perimeter, comprising:

a plurality of portable workspace modules adapted for positioning in a freestanding fashion on the building floor; each of said workspace modules having an open bottom partition with a plan footprint that is substantially identical with the plan footprint of like ones of said workspace modules, and defines a private workspace configured to support a user therein, and includes an enlarged portal opening sized to permit unobstructed user ingress and egress therethrough, and an associated movable door partition with an outwardly protruding top plan configuration oriented to increase the size of the associated private workspace when said door partition is closed by capturing a portion of the floor area immediately outside of said portal opening;

said workspace modules being positioned in a generally side-by-side fashion along the perimeter of the floor area, and oriented with each said portal opening facing inwardly toward a central portion of the floor area to define a common workspace, whereby when said door partitions are shifted fully opened, that portion of the building floor occupied by said common workspace is maximized for collaborative co-worker activities, and when said door partitions are shifted fully closed, that portion of the building floor occupied by all said private space is maximized for individual worker activities.

2. An office arrangement as set forth in claim 1, wherein:

said portal opening of each of said workspace modules extends across a major portion of a front side of the associated workspace module, such that when the associated door partition is in the fully open position, the private workspace of the associated workspace module becomes annexed to the common workspace.

3. An office arrangement as set forth in claim 2, wherein:

said door partition of each of said workspace modules is moveably suspended in a cantilevered fashion from the associated workspace module, such that when the associated door partition is in the fully open position, the associated portal opening is without lintel or threshold, whereby the private workspace of the associated workspace module flows directly and homogeneously into the common workspace.

4. An office arrangement as set forth in claim 3, wherein:

said door partition associated with at least one of said workspace modules has an arcuate plan configuration.

5. An office arrangement as set forth in claim 4, wherein:

said door partition associated with at least one of said workspace modules is positioned to alter the shape of the associated private workspace when said door partition is closed.

6. An office arrangement as set forth in claim 5, wherein:

at least one of said workspace modules includes a freestanding framework adapted to be abuttingly supported on the building floor.

7. An office arrangement as set forth in claim 6, wherein:

said one workspace module includes a sidewall partition arrangement supported on said framework, and defining a three-sided workspace.

8. An office arrangement as set forth in claim 7, wherein:

said workspace associated with said one workspace module has a preselected amount of interior space sufficient to support at least one user therein.

9. An office arrangement as set forth in claim 8, wherein:

at least one of said workspace modules includes means associated with an exterior portion of the associated door partition for visually indicating in selected increments the relative location of said door partition between fully open position and fully closed positions to facilitate achieving a better balance between worker privacy and work interaction.

10. An office arrangement as set forth in claim 9, wherein:

said framework is sufficiently rigid to permit said workspace module to be bodily transported in a fully assembled condition between different project sites.

11. An office arrangement as set forth in claim 10, wherein:

said framework includes a rigid, overhead frame, and at least three vertical columns connected with and supporting said overhead frame above the floor surface at a predetermined elevation generally above average user height.

12. An office arrangement as set forth in claim 11, wherein:

said vertical columns are mutually spaced apart in a preselected triangular plan relationship, with the associated portal opening being disposed inbetween two of said vertical columns.

13. An office arrangement as set forth in claim 12, wherein:

said overhead frame and said vertical columns are detachably interconnected to facilitate quickly and easily assembling and disassembling said workspace module at different locations.

14. An office arrangement as set forth in claim 13, wherein:

said overhead frame and said vertical columns include means for routing wires therealong to equip said one workspace module with power and signal.

15. An office arrangement as set forth in claim 14, including:

an overhead support positioned in the central portion of the floor area at a predetermined elevation above average user height;

a plurality of panels, each being constructed to permit easy, manual, bodily translation of the same by an adult user, and including means for detachably connecting the same with said overhead support in a manner in which each of said panels hangs downwardly from said overhead support in a generally vertical orientation, and is readily and easily removable therefrom by the user; and hanger means associated with said overhead support, and cooperating with the detachable connecting means of said panels to permit each of said panels to be individually and detachably hung at various locations along said overhead support.

16. An office arrangement as set forth in claim 15, wherein:

said overhead support is configured to permit said panels to be removably hung therefrom and reconfigurable between at least a first arrangement wherein said panels contribute to defining a meeting workspace portion of the floor surface which is at least spatially and visually distinct from the rest of the floor surface, and is sufficiently large to comfortably accommodate at least one adult user therein for selected activities, and a second arrangement wherein at least some of said panels are removed from said overhead support and stored to permit free movement through the common workspace.

17. An office arrangement as set forth in claim 16, wherein:

said overhead support is configured to permit said panels to be removably hung therefrom and reconfigurable between at least a first arrangement wherein said panels define a group meeting workspace portion of the floor surface which is at least spatially and visually distinct from the rest of the floor surface, and is sufficiently large to comfortably accommodate a plurality of adult users therein for communal communications and actions, and a second arrangement wherein said panels subdivide the group meeting workspace into at least two, sub-group meeting workspaces which are at least spatially and visually distinct from one another, and are sufficiently large to accommodate at least one adult user therein for breakout-type communications and actions.

18. An office arrangement as set forth in claim 3, wherein:

said door partition associated with at least one of said workspace modules is positioned to alter the shape of the associated private workspace when said door partition is closed.

19. An office arrangement as set forth in claim 3, wherein:

at least one of said workspace modules includes a free-standing framework adapted to be abuttingly supported on the building floor.

20. An office arrangement as set forth in claim 3, wherein:

at least one of said workspace modules includes a side-wall partition arrangement defining a three-sided workspace.

21. An office arrangement as set forth in claim 3, wherein:

at least one of said workspace modules includes means associated with an exterior portion of the associated door partition for visually indicating in selected increments the relative location of said door partition between fully open position and fully closed positions to facilitate achieving a better balance between worker privacy and worker interaction.

22. An office arrangement for open plan spaces and the like of the type having a building floor with a predetermined floor area defined by a set perimeter, comprising:

a plurality of portable workspace modules adapted for positioning in a freestanding fashion on the building floor; each of said workspace modules having a substantially identical footprint defining a private workspace, and including a portal opening, and an associated movable door partition; said workspace module being positioned in a generally side-by-side fashion along the perimeter of the floor area, and oriented with each said portal opening facing inwardly toward a central portion of the floor area to define a common workspace; and means for shifting the door partitions of said workspace modules, whereby when said door partitions are fully opened the amount of said common workspace is maximized for collaborative coworker activities, and when said door partitions are fully closed the cumulative amount of said private space is maximized for individual worker activities;

an overhead support with means for positioning the same in the common workspace at a predetermined elevation above average user height;

a plurality of panels, each being constructed to permit easy, manual, bodily translation of the same by an adult user, and including means for detachably connecting the same with said overhead support in a manner in which each of said panels hangs downwardly from said overhead support in a generally vertical orientation, and is readily and easily removable therefrom by the user; and hanger means associated with said overhead support, and cooperating with the detachable connecting means of said panels to permit each of said panels to be individually and detachably hung at various locations along said overhead support.

23. An office arrangement as set forth in claim 22, wherein:

said door partitions have an arcuate plan configuration.

24. An office arrangement as set forth in claim 23, wherein:

said overhead support is configured to permit said panels to be removably hung therefrom and reconfigurable between at least a first arrangement wherein said panels contribute to defining a meeting workspace portion of the floor surface which is at least spatially and visually distinct from the rest of the floor surface, and is sufficiently large to comfortably accommodate at least one adult user therein for selected activities, and a second arrangement wherein at least some of said panels are removed from said overhead support and stored to permit free movement through the common workspace.

25. An office arrangement as set forth in claim 24, wherein:

said overhead support is configured to permit said panels to be removably hung therefrom and reconfigurable between at least a first arrangement wherein said panels define a group meeting workspace portion of the floor surface which is at least spatially and visually distinct from the rest of the floor surface, and is sufficiently large to comfortably accommodate a plurality of adult users therein for communal communications and actions, and a second arrangement wherein said panels subdivide the group meeting workspace into at least two, sub-group meeting workspaces which are at least spatially and visually distinct from one another, and are sufficiently large to accommodate at least one adult user therein for breakout-type communications and actions.

26. An office arrangement as set forth in claim 25, wherein:

at least one of said panels includes means for visually dividing one portion of the floor area from another portion thereof.

27. An office arrangement as set forth in claim 26, wherein:

at least one of said panels has an acoustic construction to attenuate sound transmission into and out of the common workspace.

28. An office arrangement as set forth in claim 27, wherein:

at least one of said panels has means for displaying information thereon.

29. An office arrangement as set forth in claim 28, wherein:

said overhead support includes a rigid framework supported freestanding on the building floor by a plurality of columns.

30. An office arrangement as set forth in claim 29, wherein:

said columns and said framework include means for routing wires therealong to equip said furniture system with power and signal.

31. An office arrangement as set forth in claim 30, including:

a mobile cart having a ground engaging support with means for permitting manual translation of said cart over the building floor, and hanger means cooperating with the detachable connecting means of said panels to detachably support at least one of said panels on said mobile cart in a hanging fashion, and thereby facilitate the configuration and reconfiguration of said panels.

32. A furniture system as set forth in claim 31, wherein:

said mobile cart comprises at least one inclined surface, which is adapted to support said one panel thereagainst, and includes means for displaying information thereon which is functional at least when said one panel is removed from said mobile cart.

33. A workspace module for open office plan spaces and the like of the type having a floor surface, comprising:

a partition having three closed sides defining a workspace shaped to support at least a single user therein, and an open side defining a portal opening shaped to permit user ingress and egress therethrough; said partition being configured to be positioned freestanding on the floor surface, and oriented with said portal opening facing inwardly toward a central portion of the floor surface to define a common workspace;

a door partition configured to selectively close said portal opening, and being movable between a fully open position and a fully closed position; said door partition being mounted on said partition, and being supported thereon above the floor surface without threshold and/or lintel, whereby when said door partition is shifted into the fully closed position, said workspace is physically separated from said common workspace to maximize worker privacy, and when said door partition is shifted into the fully open position, said workspace opens directly into and becomes a fully contiguous and homogenous part of the common workspace to maximize worker collaboration.

34. A workspace module as set forth in claim 33, wherein:

said door partition has an arcuate plan configuration.

35. A workspace module as set forth in claim 33, wherein:

said door partition is positioned to alter the shape of the workspace when said door partition is closed.

36. A workspace module as set forth in claim 33, wherein:

said door partition includes indicia associated with an exterior portion thereof for visually indicating in selected increments the relative location of said door partition between fully open position and fully closed position to facilitate achieving a better balance between worker privacy and worker interaction.

* * * * *